US006948548B2

(12) United States Patent
Yanagimoto et al.

(10) Patent No.: US 6,948,548 B2
(45) Date of Patent: Sep. 27, 2005

(54) APPARATUS AND METHOD FOR CASTING METAL

(75) Inventors: Shigeru Yanagimoto, Kitakata (JP); Masashi Fukuda, Kitakata (JP); Tomoo Uchida, Kitakata (JP); Kunio Hirano, Kitakata (JP)

(73) Assignee: Showa Denko K.K., Tokyo (JP)

( * ) Notice: Subject to any disclaimer, the term of this patent is extended or adjusted under 35 U.S.C. 154(b) by 120 days.

(21) Appl. No.: 10/111,975

(22) PCT Filed: Aug. 31, 2001

(86) PCT No.: PCT/JP01/07552

§ 371 (c)(1),
(2), (4) Date: Apr. 30, 2002

(87) PCT Pub. No.: WO02/18076

PCT Pub. Date: Mar. 7, 2002

(65) Prior Publication Data

US 2004/0211544 A1 Oct. 28, 2004

Related U.S. Application Data

(60) Provisional application No. 60/251,383, filed on Dec. 6, 2000, and provisional application No. 60/251,389, filed on Dec. 6, 2000.

(30) Foreign Application Priority Data

Sep. 1, 2000 (JP) ..... 2000-266066
Sep. 22, 2000 (JP) ..... 2000-288137

(51) Int. Cl.[7] ..... B22D 17/26

(52) U.S. Cl. ..... 164/342; 164/371; 164/372; 164/365; 164/369; 164/338.1; 164/358; 164/359

(58) Field of Search ..... 164/342, 371, 164/372, 365, 369, 338.1, 122.1, 133, 134, 358, 359, 465; 148/437

(56) References Cited

U.S. PATENT DOCUMENTS 3,790,324 A * 2/1974 Susin ..... 425/567
4,907,640 A * 3/1990 Jeanneret ..... 164/134
5,769,147 A * 6/1998 Yanagimoto et al. .... 164/122.1

FOREIGN PATENT DOCUMENTS

JP 03-36343 * 9/1991
JP 04-75748 * 3/1992
JP 05-146846 * 6/1993
JP 08-155627 A 6/1996
JP 09-174198 A 7/1997

* cited by examiner

*Primary Examiner*—Tom Dunn
*Assistant Examiner*—I.-H. Lin
(74) *Attorney, Agent, or Firm*—Sughrue Mion, PLLC

(57) ABSTRACT

An apparatus for casting an ingot includes a molten metal reservoir (51) positioned at an upper portion, a casting chamber (5) positioned at a lower portion and a partition wall (3) between the reservoir and the chamber, a spruce (7) formed in the partition wall, an opening/closing plug (8) for opening and closing the sprue and control means for controlling an opening and closing operation of the plug. The casing chamber is defined in a mold (1) that includes a lower mold member (4), a side mold member (2) and the partition wall (3) that constitutes an upper mold member. At least one of the lower mold member, side mold member and upper mold member includes a plurality of divided sections (21, 22) in accordance with a shape of a cast ingot C.

22 Claims, 22 Drawing Sheets

APPARATUS AND METHOD FOR CASTING METAL

CROSS-REFERENCE TO RELATED APPLICATION

This application is a 371 of PCT/JP01/07552 filed on Aug. 31, 2001 which claims benefit of 60/251,383 filed on Dec. 6, 2000 and claims benefit of 60/251,389 filed on Dec. 6, 2000.

TECHNICAL FIELD

The present invention relates to an apparatus for casting metal, with a mold used for casting stocks for plastic forming, particularly cast ingots for forging, and to a method for casting metal using the apparatus.

BACKGROUND ART

FIG. 32 is a schematic view showing a conventional apparatus for casting metal with a mold 1. The mold 1 comprises a lower mold member 4 serving as a cooling plate, a side mold member 2 disposed on the lower mold member and an upper mold member 3 having an upper wall 31. The inner surface of the side mold member 2 is a generally hollow cylindrical surface with a diameter increased downward, specifically sloped at not more than 5° (i.e., a sloped surface for facilitating removal of a cast ingot). The lower surface of the upper mold member 3, the inner surface of the side mold member 2 and the upper surface of the lower mold member 4 define a casting chamber 5. The upper surface of the upper mold member 3 and the inner surface of the upper wall 31 define a molten metal reservoir 51 that is for storing molten metal M teamed from, for example, a melting furnace (not illustrated). Thus, the bottom of the reservoir 51 is the upper surface of the upper mold member 3. A mortar-shaped molten metal inlet (sprue) 7 is provided in the center portion of the upper mold member 3.

The upper surface of the side mold member 2 is fitted to the lower surface of the upper mold member 3 by means of non-illustrated predetermined fitting means, such as fitting screws.

The sprue 7 is opened and closed by an opening/closing plug 8. When the plug 8 is moved upward by means of a non-illustrated plug-driving apparatus, the sprue 7 is opened, and the molten metal M is teemed into the casting chamber 5. When the plug is moved downward by means of the plug-driving apparatus, the sprue 7 is closed, and teeming of the molten metal M into the casting chamber is stopped.

The cooling plate (lower mold member) 4, side mold member 2, bottom of the molten metal reservoir 51 (upper mold member 3) and plug 4 constitute the mold 1 for casting a columnar ingot C having generally flat, parallel, upper and lower surfaces.

Beneath the cooling plate 4 is disposed a spray nozzle 6 for spraying water to the lower surface of the cooling plate 4 to thereby cool the cooling plate 4. The spray nozzle 6 is fixedly accommodated in a hollow cylindrical case 63 that includes a drain outlet 64 for discharging the cooling water used and supports thereon the cooling plate 4 that is separated from the side mold member 2 before use of the metal-casing apparatus.

Around the mold 1 is disposed an electric furnace 53 for maintaining the temperature of the molten metal M teemed into the casting chamber 5 at a predetermined temperature in order to prevent the molten metal M from being cooled by the side wall of the mold 1.

Above the upper wall 31 of the upper mold member 3 is disposed an upper lid 61 for closing the upper portion of the molten metal reservoir 51, that includes a through-hole 62 through which the plug 8 is inserted.

Casting of the ingot C will next be described.

Firstly, the cooling plate 4, spray nozzle 6 and hollow cylindrical case 63 are moved upward by means of a non-illustrated lower mold member (cooling plate) driving apparatus, closing the lower portion of the side mold member 2 with the cooling plate 4.

Subsequently, the opening/closing plug 8 is moved upward by means of the non-illustrated plug-driving apparatus. After the molten metal M is teemed into the casting chamber 5 through the sprue 7 and the casting chamber 5 is filled with the molten metal M, the plug 8 is moved downward by means of the plug-driving apparatus to thereby close the sprue 7.

Subsequently, water is sprayed from the spray nozzle 6 onto the lower surface of the cooling plate 4 to thereby cool and solidify through the cooling plate 4 the molten metal M unidirectionally, i.e. from the lower portion of the side mold member 2 to the upper portion thereof (the surface of the plug 8 forming a part of the casting chamber 5), so that the solidification interface in the molten metal M is not closed.

When the molten metal M is cooled and solidified as described above, the metal M shrinks through solidification.

After the molten metal M is cooled to form a cast ingot C, the cooling plate 4, spray nozzle 6 and hollow cylindrical case 63 are moved downward by means of the cooling plate-driving apparatus. As a result, the cooling plate 4 on which the cast ingot C is placed is detached from the side mold member 2, whereby the cast ingot C can be removed from the cooling plate 4.

Cast ingots C can be produced sequentially in a manner similar to that described above.

JP-A HEI 9-174198 discloses an ingot-casing apparatus similar to the aforementioned metal-casting apparatus.

A conventional mold for casting metal is used for casting a columnar ingot having generally flat, parallel, upper and lower surfaces.

When the cast ingot is forged into a product having a complicated shape, the ingot is not subjected to satisfactory plastic forming in a forgoing mold having a complicated shape, since the ingot has substantially flat upper and lower surfaces. Therefore, since the ingot cannot be formed into such a product through a single forging operation, the ingot must be subjected to preliminary shaping.

Therefore, there has been a demand for a cast ingot that can be forged through a single forging operation into a product having a complicated shape.

The present invention contemplates realizing the aforementioned demand, and a first object of the present invention is to provide a metal-casting apparatus enabling a mold of a complicated shape for producing a three-dimensionally profiled cast ingot to be provided with ease at low cost, the cast ingot to be easily subjected to forging which is the step subsequent to casting, and to provide a method for casting metal using the metal-casting apparatus.

DISCLOSURE OF THE INVENTION

To attain the first object, the present invention provides an apparatus for casting an ingot, which comprises a molten metal reservoir positioned at an upper portion, a casting chamber positioned at a lower portion, a partition wall between the reservoir and the chamber, a sprue formed in the partition wall, an opening/closing plug for opening and closing the sprue and control means for controlling an opening and closing operation of the plug, wherein the casting chamber is defined by a mold comprising a lower mold member, a side mold member and the partition wall that constitutes an upper mold member, and at least one of the lower mold member, side mold member and upper mold member comprises a plurality of divided sections in accordance with a shape of a cast ingot.

The side mold member, lower mold member or upper mold member may be an insert member, and the insert member may have a sloped surface for facilitating withdrawal thereof.

Preferably, the mold members are mutually positioned by positioning means and provided with air removing means including a groove and a hole for discharging air which remains in the casting chamber when molten metal is teemed from the reservoir into the chamber via the sprue.

Preferably, a surface of the side mold member defining the casting chamber is sloped upward toward the air removing means or sprue.

The inventors previously proposed a casting apparatus, as disclosed in JP-A-HEI 8-155627, for producing a cast ingot having good interior quality, i.e. with no defects including casting cavities, shrinkage cavities, pinholes, invasion of oxides, etc.

The disclosed casting apparatus will be described with reference to FIG. 33, which is a schematic representation of the structure of the apparatus. The casting apparatus has a mold 1 comprising a cooling plate 4, and a side mold member 2 and an upper mold member 3 that are provided on the cooling plate 4, with an upper wall 31 formed on the upper mold member 3 and a sprue 7 formed in the center portion thereof.

The cooling plate 4, side mold member 2 and upper mold member 3 define a casting chamber 5. The upper wall 31 and upper mold member 3 define a molten metal reservoir 51. The sprue 7 is an inlet for teeming molten metal M in the molten metal reservoir 51 into the casting chamber 5. An opening/closing plug 8 is provided for being moved vertically with a plug-driving apparatus (not shown) to open and close the sprue 7. When the sprue 7 is opened with the plug 8, the molten metal reservoir 51 and the casting chamber 5 communicate with each other. The communication is cut off when the sprue 7 is closed with the plug 8. The upper wall 31 of the upper mold member 3 is connected to an electric furnace 53 so that it is heated to a predetermined temperature and maintained at the temperature.

In the casting apparatus having the aforementioned structure, firstly, a predetermined amount of molten metal M is fed into the reservoir 51 with the plug 8 fitted into the sprue 7. During feeding of the molten metal M, the electric furnace 53 is operated to thereby maintain the molten metal M in the reservoir 51 at a predetermined temperature and prevent the molten metal M from being cooled by the wall of the mold 1. Subsequently, when the plug 8 is detached from the sprue 7, the molten metal M stored in the reservoir 51 is sequentially teemed into the casting chamber 5 to thereby fill the chamber 5 with the molten metal M.

After the chamber 5 is filled with the molten metal M, the sprue 7 is closed with the plug 8, and then cooling water is sprayed from a spray nozzle 6 onto the cooling plate 4. Consequently, the molten metal M in the chamber 5 is sequentially solidified unidirectionally from the lower portion of the chamber 5 to the upper portion thereof. After the entirety of the molten metal M is solidified, when the cooling plate 4 is moved downward relative to the chamber 5, a cast body (cast ingot) C placed on the upper surface of the cooling plate 4 is removed from the cooling plate 4.

The cast body C produced through unidirectional solidification has good interior quality. Meanwhile, since the upper portion of the casting chamber 5 is closed, a consistent amount of molten can be teemed into the chamber 5 even if the amount of the molten metal is not measured. Furthermore, a meniscus portion of the molten metal is not greatly curved, and a variation in size and weight among cast bodies C does not become large.

The cast body produced in the aforementioned casting apparatus has good interior quality and satisfies requirements of the present market in terms of dimensional accuracy and appearance. However, it is obvious that, in the near future, there will be a demand for a casting apparatus for producing cast bodies with higher accuracy. Therefore, at present, there must be established a technique for producing cast bodies with higher accuracy. That is to say, a technique has to be established for attaining higher accuracy in dimension of an opening/closing plug and a sprue (specifically, dimensional accuracy on the order of 1/100 mm). When the opening/closing plug 8 is precisely fitted into the sprue 7, leakage of the molten metal M into a space between the plug 6 and the sprue 7 can be effectively prevented, and formation of casting burrs on the cast body C can be prevented. In addition, when the lower end surface of the plug 8 is made to be precisely flush with the lower surface of the upper mold member 3, there can be prevented formation of a protuberant or dented portion on the cast body C, because the portion is attributed to a step possibly existing between the plug 8 and the upper mold member 3.

Among the members constituting the aforementioned casting apparatus, the opening/closing plug 8 can be handled as a single member. Therefore, dimensional accuracy of the plug 8 per se higher than the present level can be attained relatively easily.

However, the mold 1 that includes the upper mold member 3 having the upper wall 31 and sprue 7, and the side mold member 2 has a large-sized structure. Thus, handling of the mold 1 is troublesome. Accordingly, enhancement of dimensional accuracy of the sprue 7 formed in the upper mold member 3 of the mold 1 is very difficult as compared with the case in which dimensional accuracy of the opening/closing plug 8 is improved. Thus, the cost required for forming the sprue 7 at high dimensional accuracy inevitably becomes enormously high, preventing the sprue 7 from being formed to have high dimensional accuracy.

In a view of the foregoing, a second object of the present invention is to provide a casting apparatus for easily producing a cast body of high accuracy at low cost.

To attain the second object, the present invention provides a casting apparatus for casting an ingot, which comprises a mold, a member with a wall defining a sprue that is detachably attached to the mold and an opening/closing plug brought into contact with or detached from the sprue-defining wall for opening and closing the sprue, wherein molten metal is teemed into the mold when the plug is detached from the sprue-defining wall, and teeming of the molten metal into the mold is stopped when the plug is brought into contact with the sprue-defining wall.

The mold can comprise a lower mold member, a side mold member and an upper mold member, and at least one of the three members comprises a plurality of divided sections in accordance with a shape of a cast ingot.

The mold may be provided at one end portion with forced cooling means so that the molten metal teemed into the mold may be solidified unidirectionally from the one end portion toward the other end portion. The member having the sprue-defining wall may be attached to a hole formed in the mold or to an outer surface of the mold. When the member having the sprue-defining wall is attached to the hole, the member may be fitted into the hole. Alternatively, a screw thread may be formed on the hole and the member having the sprue-defining wall, and the member may be screwed into the hole.

Each of the mold and the member having the sprue-defining wall is preferably formed from a combination of materials having thermal conductivities enabling the molten metal teemed into the mold to be gradually solidified while a flat, continuous solidification interface can be formed. The mold and the member having the sprue-defining wall are preferably formed from a combination of materials, such that a thermal expansion coefficient of the member material is equal to or lower than that of the mold material. The mold and the member having the sprue-defining wall may be formed from a combination of materials, such that a bending strength of the member material is equal to or higher than that of the mold material. In the case, the bending strength of the member material is equal to or higher than that of the opening/closing plug.

BEST MODE FOR CARRYING OUT THE INVENTION

The metal casting apparatus according to the present invention is employed for producing a variety of cast bodies including metallic cast ingots that are used as stocks for plastic working, such as cool forging, hot forging, closed die forging, rolling, extrusion or rolling forming, and cast products assuming a product shape. Examples of the raw material of the cast body include steel. Preferably, the raw material of the cast body is a non-iron metal such as aluminum, zinc, magnesium or alloy thereof.

In the metal casting apparatus shown in FIG. 1 through FIG. 20, at least one of a lower mold member, an upper mold member and a side mold member that constitute a mold comprises a plurality of divided sections in accordance with the shape of a cast ingot.

In the metal casting apparatus shown in FIG. 20 through FIG. 31, a separate member with a wall defining a sprue is detachably attached to a mold, and an opening/closing plug is brought into contact with and departed from the sprue-defining wall.

Figure 32:
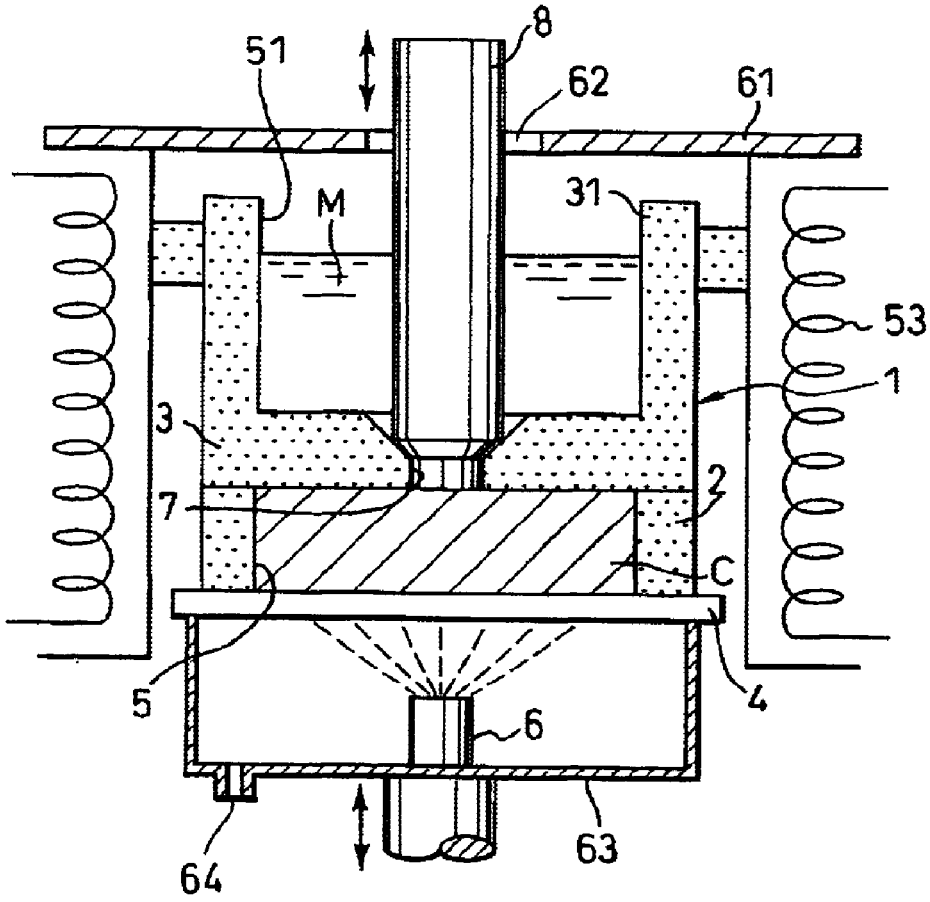
FIG. 32 is a cross-sectional view schematically showing a conventional casting apparatus.
Figure 33:
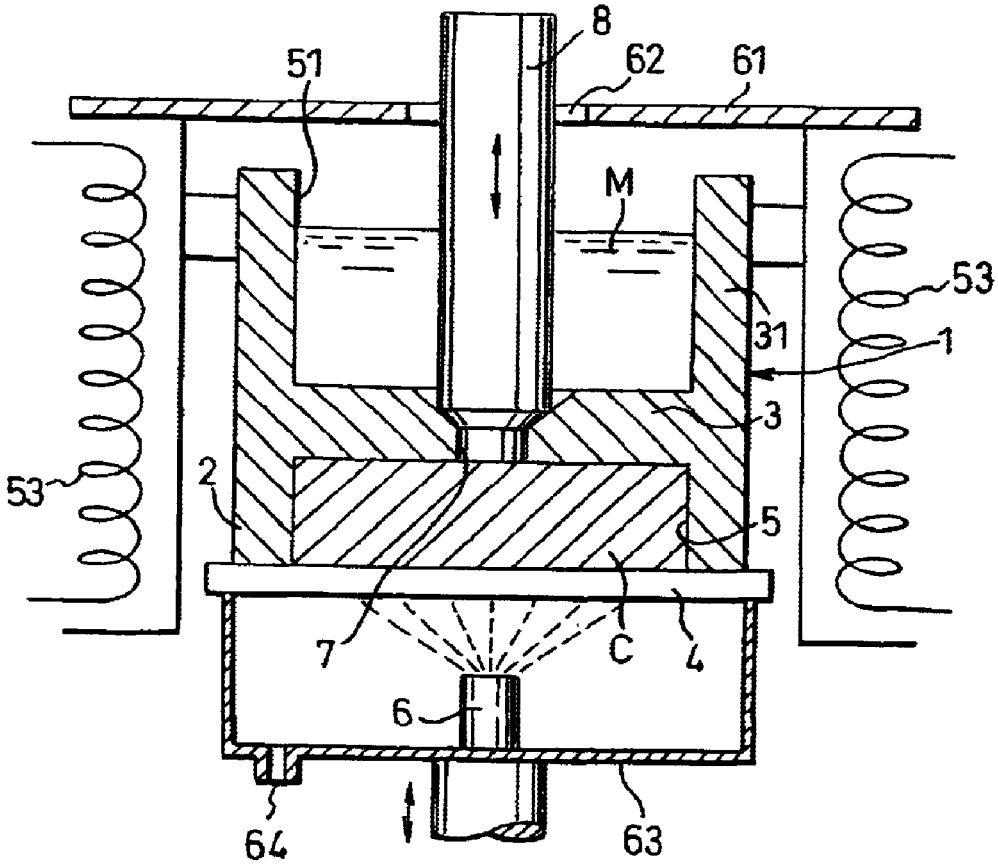
FIG. 33 is a cross-sectional view schematically showing another conventional casting apparatus.

FIGS. 1, 7, 13 and 16 each show the principal configuration of the casting apparatus according to the present invention. Though some constituent parts of the casting apparatus are omitted from the these figures, the entire configuration thereof is similar to that shown in FIG. 32. The constituent parts in these figures identical with or similar to those in FIG. 32 are given same reference numerals, and the description thereof is omitted.

Figure 1:
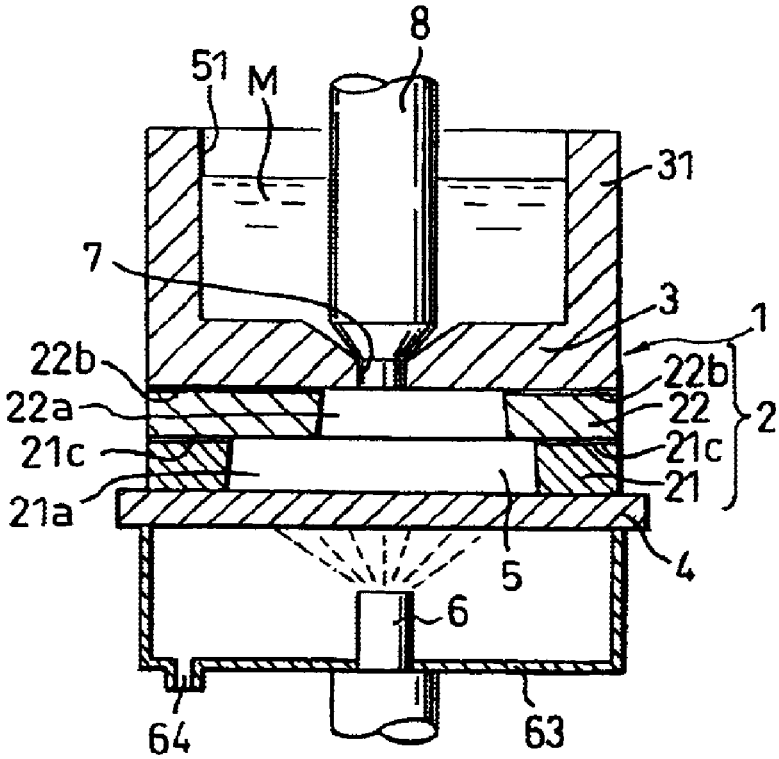
FIG. 1 is a cross-sectional view showing a metal casting apparatus according to a first embodiment of the present invention.
Figure 2:
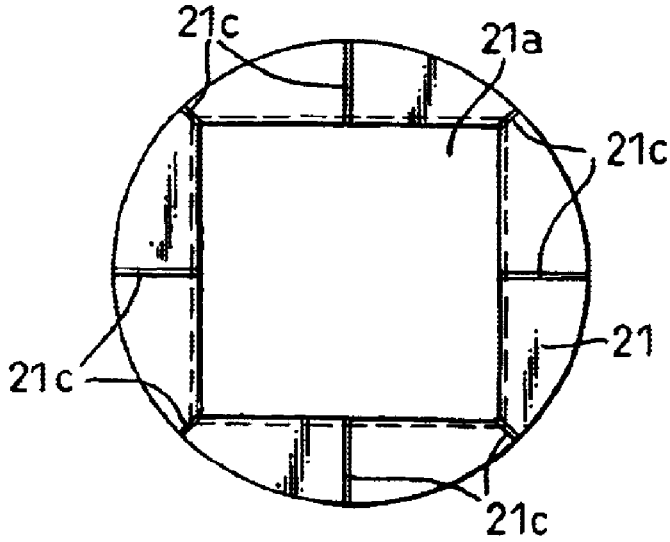
FIG. 2 is a plan view of a lower section of a side mold member used in the apparatus shown in FIG. 1.
Figure 3:
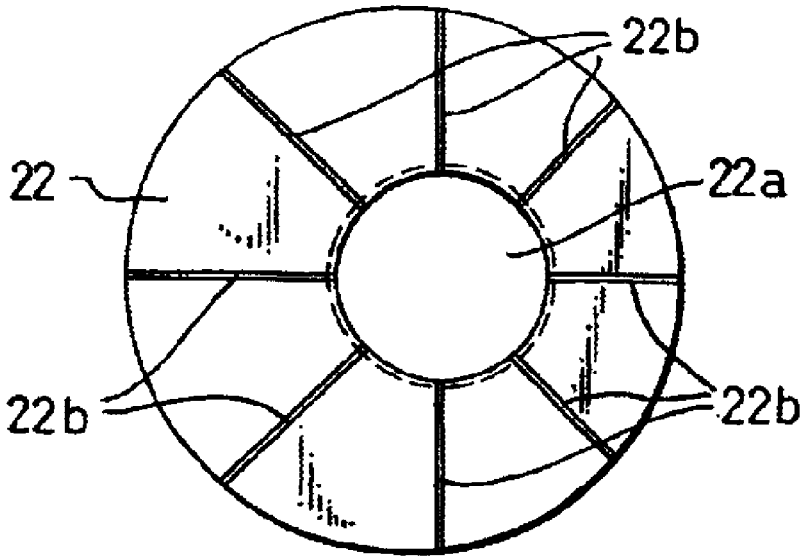
FIG. 3 is a plan view of an upper section of the side mold member used in the apparatus shown in FIG. 1.

FIG. 1 to FIG. 3 show a metal casting apparatus according to a first embodiment of the present invention, in which a side mold member 2 constituting a mold 1 comprises a lower section 21 and an upper section 22.

The lower section 21 of the side mold member 2 is formed with a rectangular through-hole 21*a* (FIG. 2).

Air removing grooves 21*c* (air removing means) through which not molten metal M but air can be passed are provided on the upper surface of the lower section 21 of the side mold 2 in a radial direction.

The air removing grooves 21*c* will be described. The depth of the grooves is 40 $\mu$m to 200 $\mu$m inclusive, preferably 40 $\mu$m to 100 $\mu$m inclusive, more preferably 40 $\mu$m to 70 $\mu$m inclusive. The width thereof is at least 2 mm. The effective length thereof is 1 mm to 30 mm inclusive, preferably 2 mm to 30 mm inclusive. The vertical cross section of each groove may assume a rectangular or circular shape.

The effective length of the air removing grooves 21*c* is determined to be at least 1 mm or 2 mm but 30 mm or less in order to prevent failure of air removal by virtue of the viscous resistance of air and to facilitate formation of the grooves 21*c*.

When the effective length of each air removing groove 21*c* is 30 mm or more, the depth of a portion thereof 30 mm or more apart from the rectangular through-hole 21*a*, i.e. the area of the vertical cross section of the portion, may be increased so as to allow air to pass through the groove easily.

Air removing grooves described below are formed in a manner similar to those described above. When air removing holes are formed instead of the air removing grooves, or when air removing paths are formed by use of a liner, the holes or paths may be formed in a manner similar to that described above.

The liner is preferably formed from a refractory material, such as a metallic plate of stainless steel or iron, a ceramic plate or a ceramic fiber sheet.

When the depth of the air removing grooves 21*c* exceeds 200 $\mu$m, in order to prevent invasion of molten metal M into the grooves, it is preferable to provide a switch valve in each of the grooves 21*c*, or means for supplying pressurized gas to the grooves.

The upper section 22 constituting the side mold member 2 is formed with a circular through-hole 22*a* (FIG. 3).

Air removing grooves 22*b* (air removing means) through which not molten metal M but air can be passed are provided on the upper surface of the upper section 22 of the side mold member 2 in a radial direction at predetermined intervals with respect to a circumferential direction.

Figure 4:
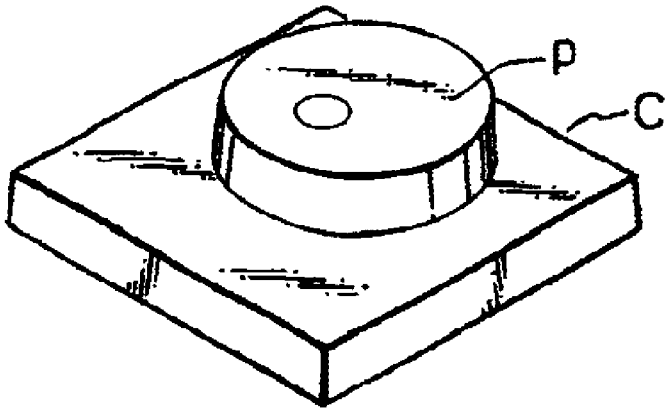
FIG. 4 is a perspective view of a cast ingot produced by use of the metal casting apparatus shown in FIG. 1.

The inner wall surfaces of the lower and upper sections 21 and 22 of the side mold member 2 defining the through-holes 21*a* and 22*a* preferably have a diameter increasing downward and is sloped at 5° or less to have a sloped surface for facilitating removal of a cast ingot C (FIG. 4).

The slope of the sloped surface is determined to 5° or less for the reasons described below. When the slope exceeds 5°, the difference in size between the upper and lower peripheries of the cast ingot C becomes large, resulting in deterioration in the quality of a forged product.

The center axes of the through-holes 21*a* and 22*a* may be coincident with or different from each other.

The side mold member upper section 22 is positioned below the bottom (upper mold member 3) of the molten metal reservoir 51 by means of non-illustrated positioning means such as a combination fitting pin-and-groove and attached to the bottom by means of non-illustrated attachment means such as attachment screws. The side mold member lower section 21 is positioned below the side mold member upper section 22 by means of non-illustrated positioning means such as a combination fitting pin-and-groove and attached to the upper section 22 by means of non-illustrated attachment means such as attachment screws.

The process for casting an ingot C by use of the side mold member lower section 21 and the side mold member upper section 22 will next be described, omitting the same steps as those included in the aforementioned conventional casting process.

When the opening/closing plug 8 is moved upward to teem the molten metal M into the casting chamber 5 through the sprue 7, air confined in the casting chamber is discharged to the outside through the air removing grooves 21*c* and 22*b* provided in the side mold member sections 21 and 22, respectively. Therefore, the molten metal M is spread over the casting chamber 5.

The description of the same steps as those included in the conventional casting process is omitted. Through the casting process of the present invention, a cast ingot C having a convex portion p can be produced as shown in FIG. 4.

Figure 5:
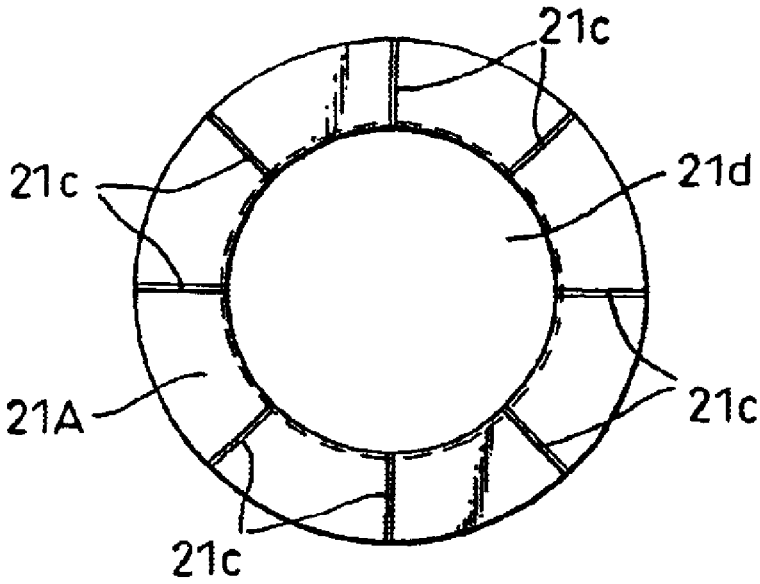
FIG. 5 is a plan view of another side mold member lower section that is combined with the upper section of the side mold member shown in FIG. 3 to produce a cast ingot different from that shown in FIG. 4.
Figure 6:
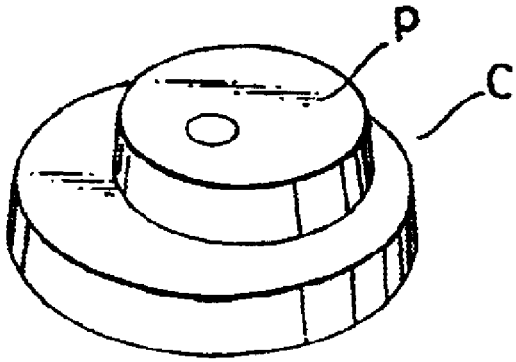
FIG. 6 is a perspective view of a cast ingot produced by use of the side mold member lower section shown in FIG. 5 and the upper section of the side mold member shown in FIG. 3.

When the side mold member lower section 21A is replaced with the side mold member lower section having the through-hole 21*d* shown in FIG. 5, a cast ingot C having a convex portion p can be produced as shown in FIG. 6.

As described above, according to the first embodiment of the present invention, in accordance with the shape of cast ingot C, the side mold member 2 is horizontally divided into the upper section 22 and the lower section 21, at, for example, a portion at which the vertical cross section of the casting chamber 5 is reduced in area and the through-hole 22*a* of the upper molding member 22, when projected, is included in the through-hole 21*a* or 21*d* of the lower molding member 21. Therefore, the divided sections 21 and 22 of the side mold member 2 have simple shapes and can thus be formed simply and easily by use of customary tools.

Therefore, a mold having a complicated shape can be easily obtained at low cost, the mold being used for producing a three-dimensionally profiled cast ingot having at least two surfaces and no cut surface. The cast ingot is formed of a combination of at least two parts having different shapes, e.g. cylinders of different diameters, a cylinder and a rectangular prism, or a truncated cone and a truncated pyramid. At least one of the lower surface, side surface and upper surface of the cast ingot is a curved surface and each of the surfaces of the cast ingot is in its entirety an as-molded surface. When this mold is employed, there can be produced a three-dimensionally profiled cast ingot C having no cut surface, each of the surfaces of the cast ingot being in its entirety an as-molded surface.

Preferably, some of the upper corners of the three-dimensionally profiled cast ingot have a curved surface having a radius of 1 mm or less.

Since the three-dimensionally profiled cast ingot C can be produced by use of the aforementioned mold, the cast ingot can be forged into a product having a complicated shape through a single run of forging. That is, the cast ingot C can be easily subjected to forging in the step subsequent to casting.

Since the side mold member sections 21 and 22 are mutually positioned by means of positioning means and attached to each other, a casting mold can be formed easily, and a cast ingot C having an intended shape can be produced.

Since the air removing grooves 21*a* and 22*b* are provided in the side mold member sections 21 and 22, there can be produced cast ingots C having an intended size and corners of intended shape, with a reduced variation in the weight thereof.

Since the three-dimensionally profiled cast ingots C having different shapes can be produced by merely replacing one of the side mold member sections constituting the side mold member 2 (i.e., the side mold member lower section or the side mold member upper section) while using the remaining one left intact, a plurality of metal casting molds for producing three-dimensionally profiled cast ingots C of different shapes can be easily obtained at low cost.

Figure 7:
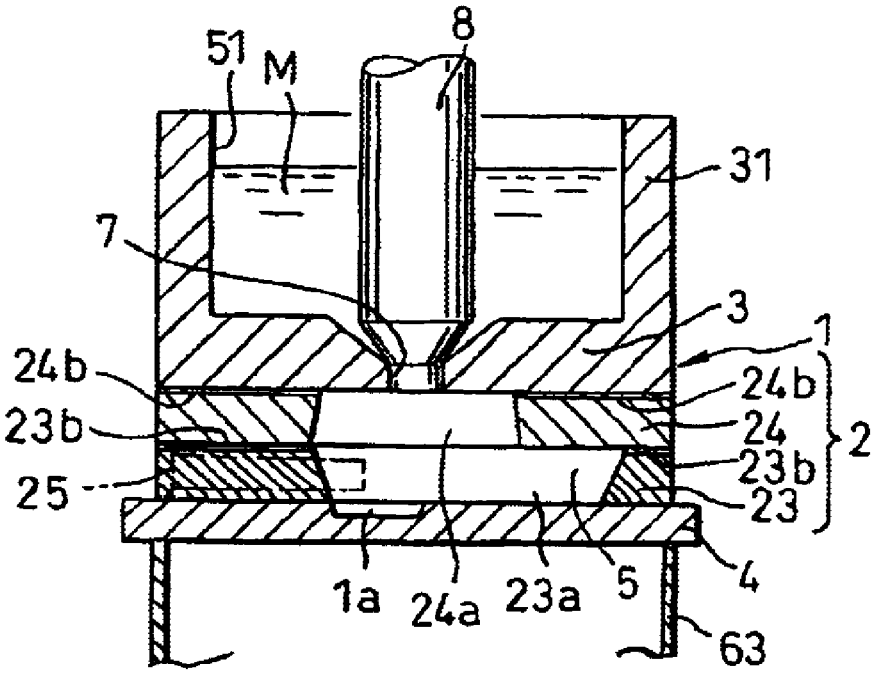
FIG. 7 is a cross-sectional view showing a metal casting apparatus according to a second embodiment of the present invention.
Figure 8:
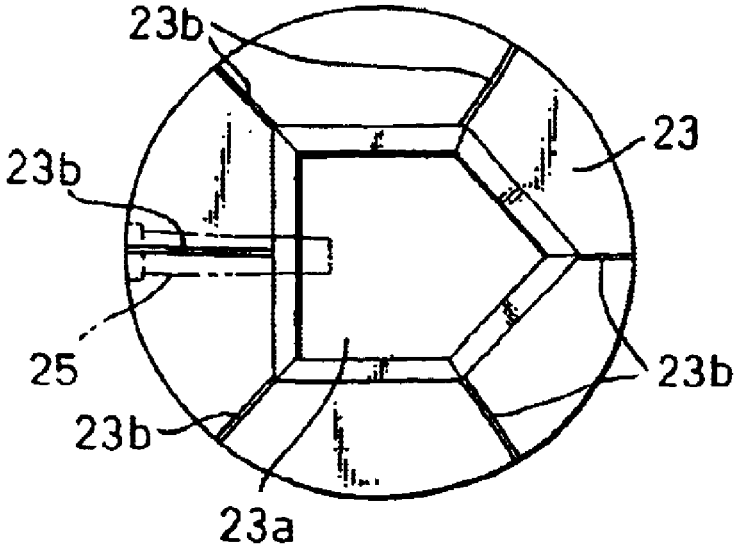
FIG. 8 is a plan view of a lower section of a side mold member used in the apparatus shown in FIG. 7.
Figure 9:
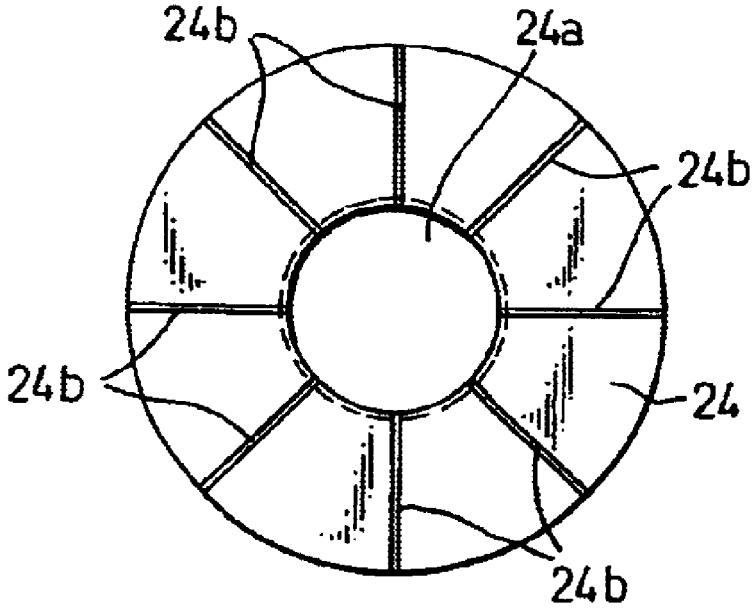
FIG. 9 is a plan view of an upper section of the side mold member used in the apparatus shown in FIG. 7.
Figure 10:
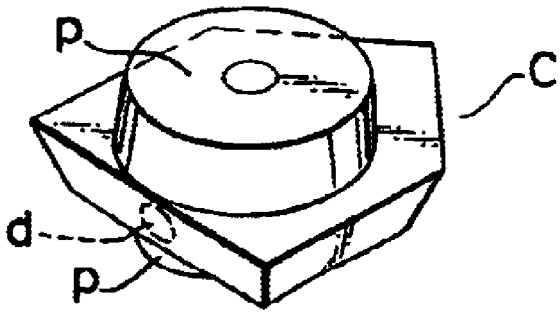
FIG. 10 is a perspective view of a cast ingot produced by use of the metal casting apparatus shown in FIG. 7.

FIG. 7 is a cross-sectional view showing a metal casting mold 1 according to a second embodiment of the present invention. FIG. 8 is a plan view of the lower section of the side mold member shown in FIG. 7. FIG. 9 is a plan view of the upper section of the side mold member shown in FIG. 7. FIG. 10 is a perspective view of cast ingot produced by use of the metal casting mold shown in FIG. 7. Identical reference numerals are assigned to the members that are identical with or corresponding to those shown in FIGS. 1 through 6 and FIG. 32, and the description of the members is omitted.

Non-illustrated means and apparatus included in the ingot casting apparatus shown in FIG. 7 are identical with those included in the ingot casting apparatus shown in FIG. 32.

In FIG. 7, reference numeral 1*a* represents a concave portion. The concave portion 1*a* is provided on the cooling plate 4 and serves as a part of the casting chamber.

The concave portion 1*a* is preferably formed so as to have an inner wall that has a diameter increasing upward and is sloped at 5° or less, thereby enabling easy removal of a cast ingot C.

In this embodiment, the side mold member 2 constituting the mold 1 comprises an upper section 24 and a lower section 23 having a pentagonal through-hole 23*a* (FIG. 8). Air removing grooves 23*b* (air removing means) through which not molten metal M but air can be passed are provided on the upper surface of the side mold member lower section 23 in a radial direction at predetermined intervals with respect to a circumferential direction.

The side mold member lower section 23 is positioned above the cooling plate 4 by means of non-illustrated positioning means such as a combination fitting pin-and-groove and attached to the cooling plate 4 by means of non-illustrated predetermined attachment means such as attachment screws.

The through-hole 23*a* is defined by the inner wall of the lower section 23 having a diameter that increases upward and having a cylindrical surface that is sloped at 5° or less.

An upper section 24 constituting the side mold member 2 has a circular through-hole 24*a* (FIG. 9). Air removing grooves 24*b* (air removing means) through which not molten metal M but air can be passed are provided on the upper surface of the side mold member upper section 24 in a radial direction at predetermined intervals with respect to a circumferential direction.

The side mold member upper section 24 is positioned below the bottom of the molten metal reservoir 51 (upper mold member 3) by means of non-illustrated positioning means such as a combination fitting pin-and-groove and attached to the upper mold member 3 by means of non-illustrated predetermined attachment means such as attachment screws.

The through-hole 24*a* is preferably defined by an inner wall of the upper section 24 having a diameter that increases downward and having a cylindrical surface that is sloped at 5° or less, thereby enabling easy removal of a cast ingot C.

The center axes of the through-holes 23*a* and 24*a* may be coincident with or different from each other.

In FIGS. 7 and 8, reference numeral 25 represents an insert member. The insert member 25 is detachably attached to the side mold member lower section 23 by means of an attachment screw, for example. The insert member 25 and the side mold member lower section 23 constitute the side mold member 2, and the insert member 25 has a sloped surface for facilitating withdrawal thereof.

When a cast ingot C having convex portions p on its upper and lower surfaces as shown in FIG. 10 is to be produced by use of the side mold member 2 including the side mold member upper section 24 and the side mold member lower section 23 not including the insert member 25 (i.e. the lower section 23 having the pentagonal through-hole 23*a* with a closed inner wall which forms the casting chamber) the casting procedure of the first embodiment is repeated, except that the cast ingot C is moved downward while being placed on the side mold member lower section 23. Therefore, the description on the casting steps for producing the cast ingot C same as those included in the casting process of the first embodiment or in the conventional casting process is omitted.

When a cast ingot C having a concave portion d on its side surface as shown in FIG. 10 is to be produced by use of the side mold member 2 including the side mold member upper section 24 and the side mold member lower section 23 including the insert member 25 as shown by means of a dashed and two-dotted line in FIGS. 7 and 8, the casting procedure of the first embodiment is repeated, except that the cast ingot C is moved downward while being placed on the side mold member lower section 23 and that the cast ingot C is removed after the insert member 25 is withdrawn. Therefore, the description on the casting steps for producing the cast ingot C same as those included in the casting process of the first embodiment or in the conventional casting process is omitted.

In the second embodiment, the same effects as obtained in the first embodiment can be obtained.

In the second embodiment, since at least one of the side mold member sections includes the insert member, a further complicated casting mold and a cast ingot C can be obtained.

Figure 11:
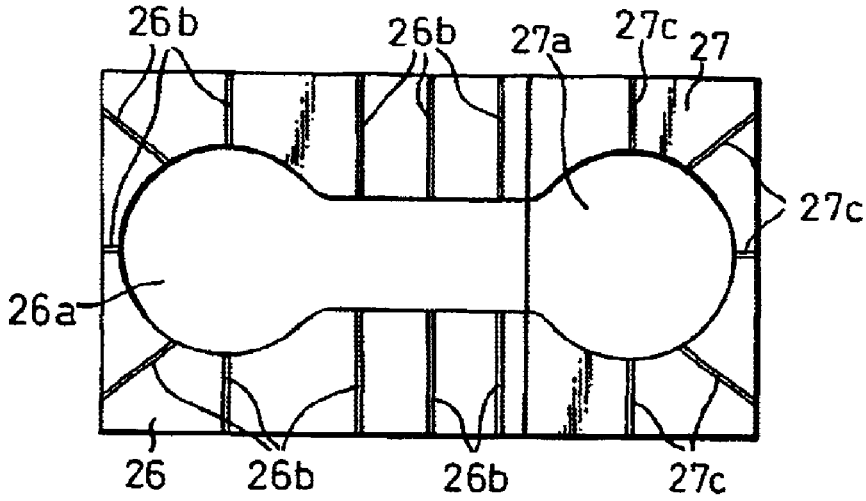
FIG. 11 is a plan view showing a metal casting apparatus according to a third embodiment of the present invention.
Figure 12:
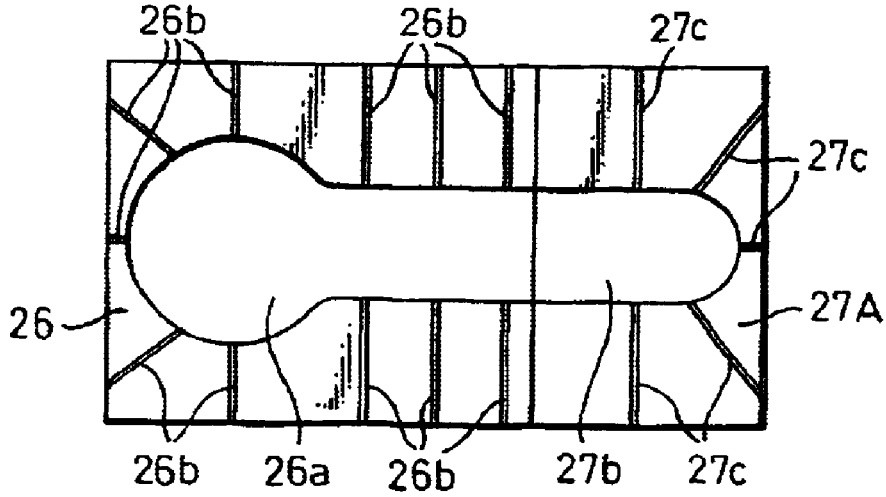
FIG. 12 is a plan view showing a metal casting apparatus according to a fourth embodiment of the present invention.

FIG. 11 is a plan view showing a metal casting mold 1 according to a third embodiment of the present invention, and FIG. 12 is a plan view showing a metal casting mold 1 according to a fourth embodiment of the present invention.

In these figures, a left section 26 constituting the side mold member 2 has a keyhole-shaped through-hole 26*a*. Air removing grooves 26*b* (air removing means) through which not molten metal M but air can be passed are provided on the upper surface of the side mold member left section 26 at predetermined intervals with respect to a circumferential direction.

Each of reference numerals 27 and 27A represents a right section constituting the side mold member 2. The side mold member right section 27 has a generally circular through-hole 27*a* of such a width that allows smooth communication with the through-hole 26*a*. The side mold member right section 27A has a straightly extending through-hole 27*b* of such a width that allows smooth communication with the through-hole 26*a*.

Air removing grooves 27*c* (air removing means) through which not molten metal M but air can be passed are provided on the upper surface of the side mold member right sections 27 and 27A at predetermined intervals with respect to a circumferential direction.

The through-holes 26*a*, 27*a* and 27*b* are each preferably defined by an inner wall of the side mold member 2 having a diameter that increases downward (i.e. toward the back side of the figures) and having a cylindrical surface which is sloped at 5° or less, thereby enabling easy removal of a cast ingot C.

Each of the side mold member left section 26 and the side mold member right sections 27 and 27A is positioned below the bottom (upper mold member 3) of the molten metal reservoir 51 by means of non-illustrated positioning means such as a combination fitting pin-and-groove and attached to the upper mold member 3 by means of non-illustrated attachment means such as attachment screws.

When a cast ingot C having a predetermined shape is to be produced by use of the side mold member 2 including the side mold member left section 26 and the side mold member right section 27 or by use of the side mold member including the side mold member left section 26 and the side mold member right section 27A, the casting process of the first embodiment or the conventional casting process is repeated. Therefore, the description of production of the cast ingot C is omitted.

In the third and fourth embodiments, the same effects as obtained in the first and second embodiments can be obtained.

Figure 13:
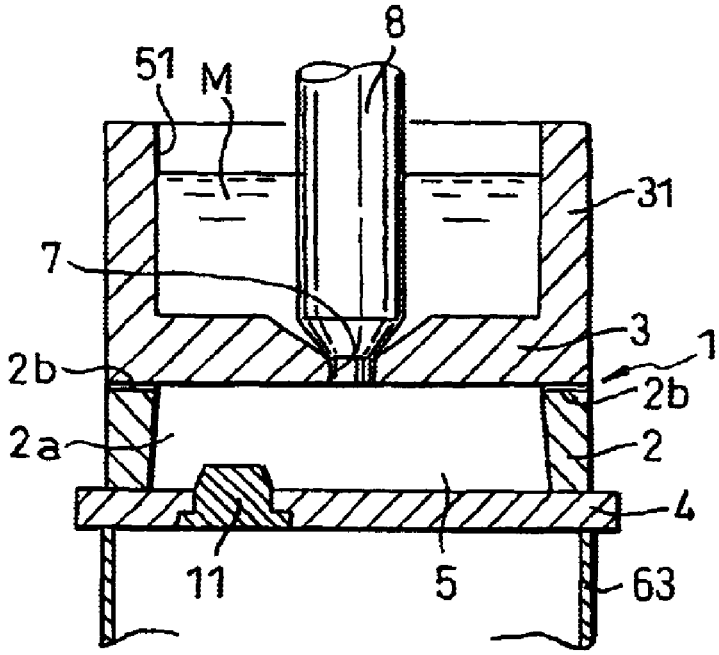
FIG. 13 is a cross-sectional view showing a metal casting apparatus according to a fifth embodiment of the present invention.
Figure 14:
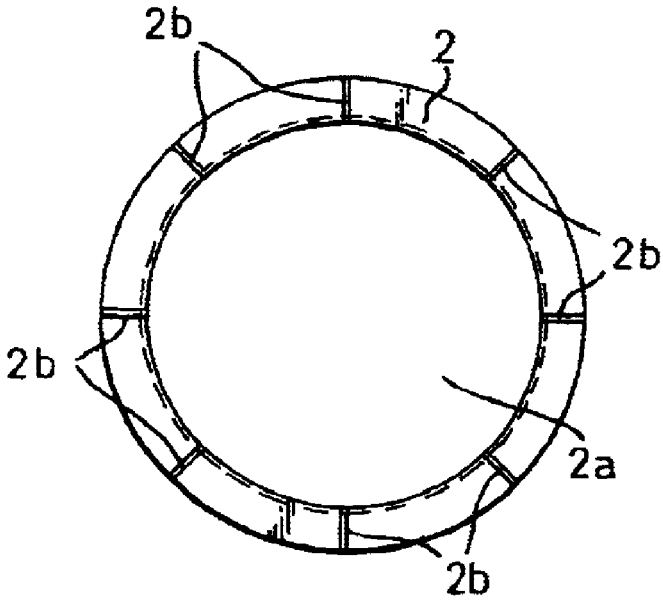
FIG. 14 is a plan view of a side mold member used in the apparatus shown in FIG. 13.
Figure 15:
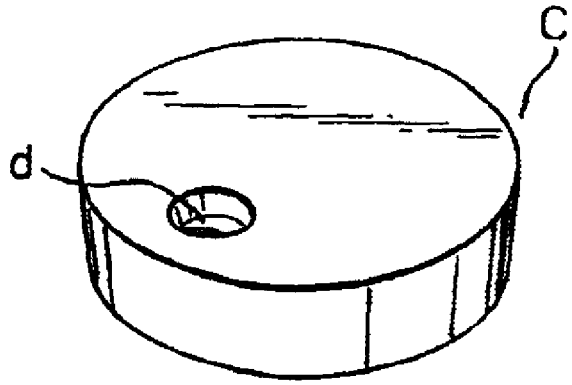
FIG. 15 is a perspective view of a cast ingot produced by use of the metal casting mold shown in FIG. 13, with the cast ingot turned upside down.

FIG. 13 is a cross-sectional view showing a metal casting mold 1 according to a fifth embodiment of the present invention. FIG. 14 is a plan view of a side mold member 2 shown in FIG. 13. FIG. 15 is a perspective view of a cast ingot C produced by use of the metal casting mold shown in FIG. 13, with the cast ingot turned upside down. Identical reference numerals are assigned to the members identical with or corresponding to those shown in FIGS. 1 through 10 and FIG. 31, and the description of the members is omitted.

Figure 31:
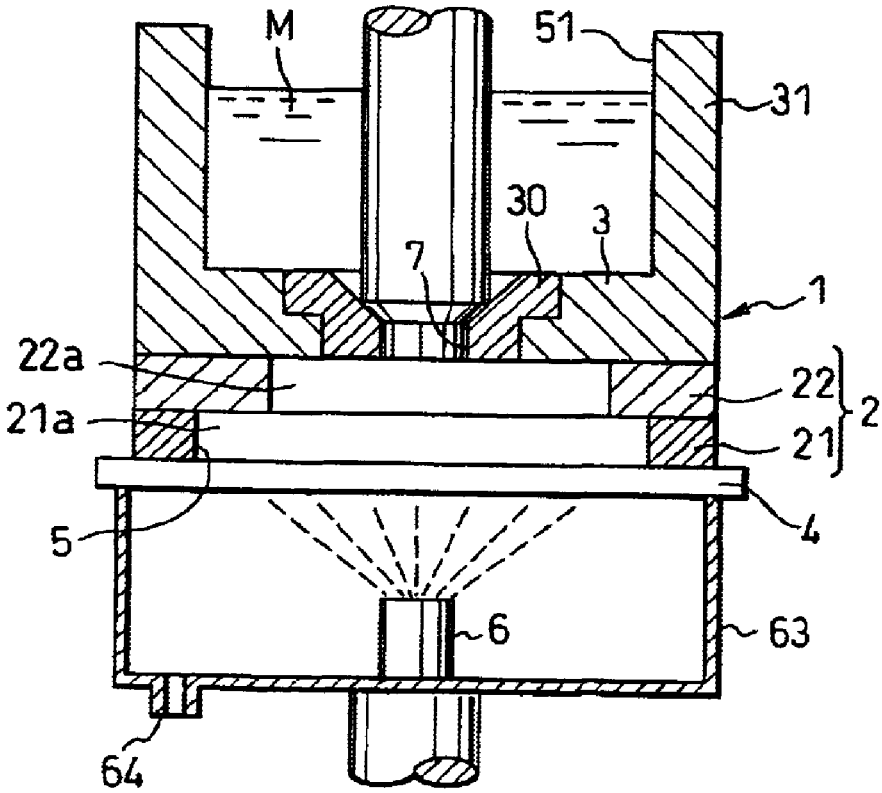
FIG. 31 is a cross-sectional view schematically showing the principal part of a metal casting apparatus according to a seventeenth embodiment of the present invention.

Non-illustrated means and apparatus included in the ingot casting apparatus shown in FIG. 13 are identical with those included in the ingot casting apparatus shown in FIG. 31.

In FIG. 13, reference numeral 11 represents an insert member. The insert member 11 is detachably attached to the cooling plate 4 by means of an attachment screw, for example. The insert member 11 and the cooling plate 4 constitute the lower mold member, and the insert member 11 is provided for producing a cast ingot C having a concave portion d assuming the shape of a truncated cone as shown in FIG. 15. The insert member 11 has a sloped surface for facilitating withdrawal thereof.

Air removing grooves 2*b* (air removing means) through which not molten metal M but air can be passed are provided on the upper surface of the side mold member 2 in a radial direction at predetermined intervals with respect to a circumferential direction. Denoted by reference numeral 2*a* is a circular through hole.

When a cast ingot C having on its bottom surface a concave portion d assuming the shape of a truncated cone as shown in FIG. 15 is to be produced by use of the metal casting mold 1 shown in FIGS. 13 and 14, the casting process of the first embodiment is repeated. Through the casting process, the cast ingot C having on its bottom a concave portion d assuming the shape of a truncated cone can be produced.

In the fifth embodiment, the same effects as obtained in the first and second embodiments can be obtained.

Figure 16:
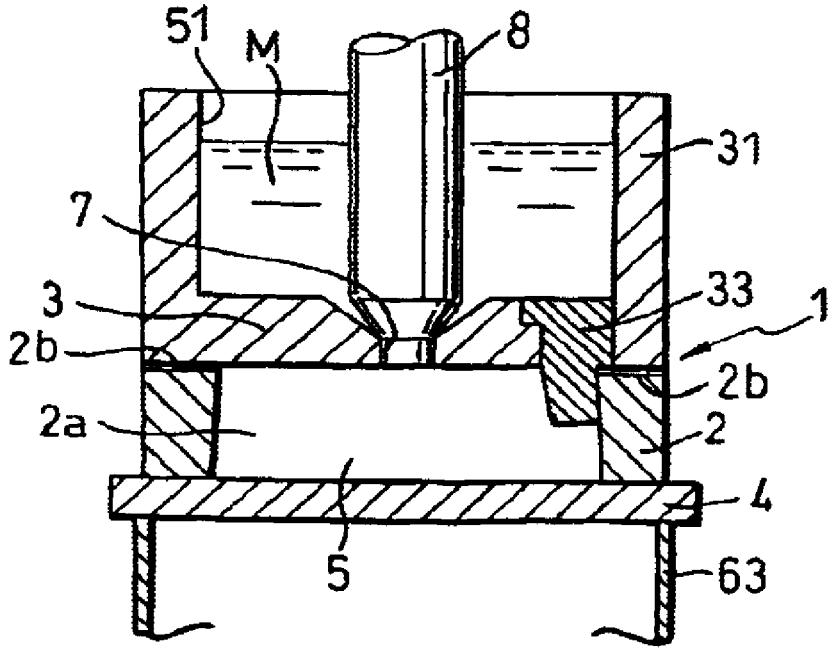
FIG. 16 is a cross-sectional view showing a metal casting apparatus according to a sixth embodiment of the present invention.
Figure 17:
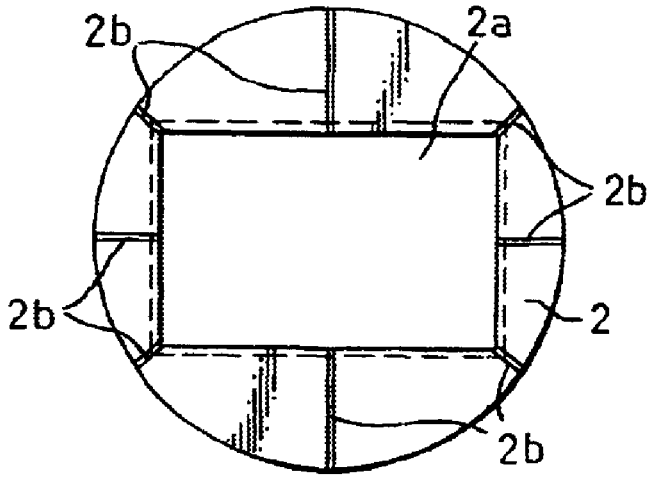
FIG. 17 is a plan view of a side mold member used in the apparatus shown in FIG. 16.
Figure 18:
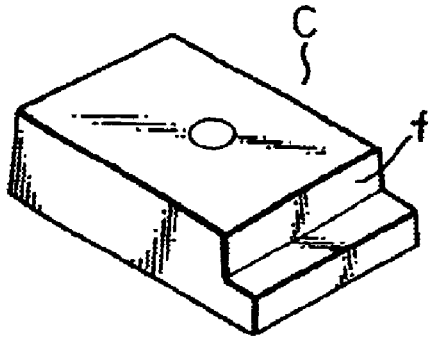
FIG. 18 is a perspective view of a cast ingot produced by use of the metal casting apparatus shown in FIG. 16.
Figure 19:
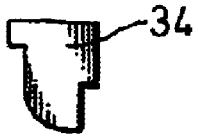
FIG. 19 is a front view showing another example of an insert member.
Figure 20:
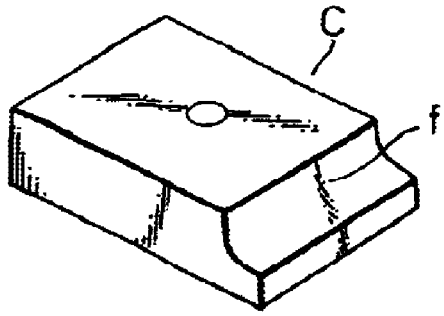
FIG. 20 is a perspective view of a cast ingot produced by use of the metal casting apparatus shown in FIG. 16 including the insert member shown in FIG. 18 instead of an insert member shown in FIG. 16.

FIG. 16 is a cross-sectional view showing a metal casting mold according to a sixth embodiment of the present invention. FIG. 17 is a plan view of a side mold member shown in FIG. 16. FIG. 18 is a perspective view of a cast ingot produced by use of the metal casting mold shown in FIG. 16. FIG. 19 is a front view showing another insert member. FIG. 20 is a perspective view of a cast ingot produced by use of the metal casting mold shown in FIG. 16 including the insert member shown in FIG. 19 instead of the insert member shown in FIG. 16. Identical reference numerals are assigned to the members identical with or corresponding to those shown in FIGS. 1 through 15 and FIG. 21, and the description of the members is omitted.

Non-illustrated means and apparatus included in the ingot casting apparatus shown in FIG. 16 are identical with those included in the ingot casting apparatus shown in FIG. 32.

In FIGS. 16 and 19, each of reference numerals 33 and 34 represents an insert member. The insert member is detachably attached to the upper mold member 3 by means of an attachment screw, for example, and has a sloped surface for facilitating withdrawal thereof.

The insert member 33 shown in FIG. 16 is provided for producing a cast ingot C having a notch f shown in FIG. 18, and the insert member 34 shown in FIG. 19 is provided for producing a cast ingot C having a notch f shown in FIG. 20.

When a cast ingot C shown in FIG. 18 or 20 is to be produced by use of the casting mold including the insert member 33 or 34, the casting process of the first embodiment is repeated. Through the casting process, the cast ingot C having a notch f can be produced.

In the sixth embodiment, the same effects as obtained in the first embodiment can be obtained.

In the aforementioned embodiments, the side mold member constituting the metal casting mold is divided into upper and lower sections or left and right sections. Alternatively, so long as a cast ingot can be removed from the casting mold, obliquely divided side mold member sections may be used in accordance with the shape of the cast ingot. Furthermore, upper and lower sections, left and right sections, and obliquely divided sections of the side mold member can be appropriately used in combination in accordance with the shape of a cast ingot, to thereby obtain the same effects as described above.

A junction surface of such a side mold member section that is joined with another side mold section may assume the form of a flat surface, a curved surface, a horizontal surface, a vertical surface or a sloped surface.

In the embodiments, only the cooling plate 4 constitutes the lower mold member, or the cooling plate 4 and the insert member 11 constitute the lower mold member. However, the lower mold member may be formed of a certain member instead of the cooling plate 4, and a portion of the side mold member may serve as the lower mold member. Alternatively, the lower mold member may be formed of a plurality of sections including no insert member.

In this case, the lower mold member may include a concave portion and a projection portion having a sloped surface for facilitating removal of a cast ingot.

When the lower mold member is formed of a plurality of sections as described above, three-dimensionally profiled cast ingots C of different shapes can be produced by replacing a part of the lower mold member sections while using the remaining part or parts left intact, and a plurality of casting molds can be obtained easily at low cost.

In the embodiments, the bottom of the molten metal reservoir 51 constitutes the upper mold member 3. However, the upper mold member 3 may be formed of a certain member instead of the bottom, and a portion of the side mold member may serve as the upper mold member. Alternatively, the upper mold member 3 may be formed of a plurality of sections including no insert member.

In this case, the upper mold member 3 may include a concave portion and a projection portion having a sloped surface for facilitating removal of a cast ingot.

When the upper mold member 3 is formed of a plurality of sections as described above, three-dimensionally profiled cast ingots C of different shapes can be produced by replacing a part of the upper mold member sections while using the remaining part or parts left intact, and a plurality of casting molds can be easily obtained at low cost.

As described above, when the lower mold member, side mold member and/or upper mold member are formed of a plurality of sections, the section close to the casting chamber differs from the section distant from the casting chamber in the degree of expansion due to heat of molten metal. Therefore, when an appropriate clearance is provided between the members constituting the casting mold in consideration of the degree of expansion, excess stress applied to the casting mold can be eliminated, and a cast ingot having an intended shape can be produced.

The embodiments employ the side mold member including a plurality of sections, the lower mold member including a plurality of sections, or the upper mold member including a plurality of sections. However, these members may be used in an appropriate combination.

The embodiments employ the mold members having a casting chamber defined by their inner walls each having a sloped surface for facilitating removal of a cast ingot. However, the mold members are not necessarily be required to have such sloped surfaces, since molten metal is solidified and shrunk to form a cast ingot, and the cast ingot is detached from the inner surface of the casting mold.

The embodiments employ an attachment screw or screws, which is an example of attachment means for joining the mold member sections with one another. However, in consideration of attachment states, conditions and accuracy, the mold member sections may be joined with one another by means of fitting, engaging or other attachment means. Other attachment means for joining the mold members of the casting mold with one another include use of a clamp or a fixing jig.

The embodiments employ a combination fitting pin-and-groove, which is an example of means for positioning the mold member sections. However, the mold member sections may be positioned by means of a combination of knock pin-and-dovetail groove, a combination of fastening bolt-and-groove or other positioning means.

In the embodiments, the surface of the upper mold member that defines the upper surface of the casting chamber is flat. However, it may be sloped upward toward the air removing means or sprue.

When the surface of the upper mold member is sloped as described above, air is easily removed from the casting chamber, and thus the molten metal is easily teemed into the sprue, and a cast ingot having corners of intended shape can be produced.

In the embodiments, the sprue is provided on the upper mold member. However, it may be provided on the side or lower mold member.

In the embodiments, the air removing means is provided on the upper surface of each side mold member section. However, the air removing means may be provided on another position of each side mold member section, so long as air can be removed from the casting chamber and a cast ingot having corners of intended shape can be produced.

In the embodiments, molten metal is cooled via the lower mold member after the casting chamber is filled with the molten metal. However, the molten metal may be cooled while being teemed into the casting chamber, so long as predetermined conditions are satisfied.

The members constituting the casting mold are preferably formed from a typical refractory material, a heat-insulating refractory material predominantly containing, for example, CaO, $SiO_2$, $Al_2O_3$ or MgO; a refractory material such as SiC, $Si_3N_4$, graphite, BN, $TiO_2$, $ZrO_2$, AlN or a mixture thereof; Fe; Cu; carbon steel; stainless steel; tool steel (e.g., SKD6 or SKD11); super steel alloy; etc.

When the cast ingot is formed from Al, Mg, Zn or alloy thereof, the casting mold is preferably formed from any one of the aforementioned materials. When the cast ingot is formed from Fe, Cu or alloy thereof, the casting mold is preferably formed from a typical refractory material; a heat-insulating refractory material predominantly containing, for example, CaO, $SiO_2$, $Al_2O_3$ or MgO; or a refractory material such as SiC, $Si_3N_4$, graphite, BN, $TiO_2$, $ZrO_2$, AlN or a mixture thereof.

The size of the casting mold and the thickness of the walls thereof are not particularly limited.

The members constituting the casting mold may be formed from an identical material. Alternatively, the members may be formed from differ materials in accordance with the shape of a cast ingot to be produced and the conditions under which the mold is to be used.

As described above, according to the present invention, a side mold member is formed of a plurality of upper and lower, left and right, and/or obliquely divided sections, in accordance with the shape of a cast ingot; a lower mold member or an upper mold member is formed of a plurality of sections in accordance with the shape of a cast ingot; or an insert member is provided in one of the members. Therefore, each of the mold member sections has a simple shape and can be simply and easily formed by use of a typical tool.

Therefore, a casting mold having a complicated shape can be easily obtained at low cost, which mold is used for producing a three-dimensionally profiled cast ingot having no cut surface. The three-dimensionally profiled cast ingot having no cut surface can be produced by use of the casting mold.

Since three-dimensionally profiled cast ingots of different shapes can be produced by merely replacing a part of the mold member sections constituting the mold member while using the remaining part left intact, a plurality of metal casting molds for producing three-dimensionally profiled cast ingots of different shapes can be easily obtained at low cost.

Since a three-dimensionally profiled cast ingot can be produced by use of the casting mold, the cast ingot can be forged into a product having a complicated shape through a single run of forging. That is, the cast ingot can be easily subjected to forging in the step subsequent to casting.

Since the mold member sections are mutually positioned by means of positioning means, the casting mold can be formed easily, and a cast ingot having an intended shape can be produced.

There is provided air removing means for discharging air which remains in a casting chamber when molten metal is teemed into the casting chamber through a sprue, and the surface of the upper mold member that defines the upper surface of the casting chamber is sloped upward toward the air removing means or sprue. Therefore, air is easily removed from the casting chamber, and thus the molten metal is easily teemed into the casting chamber. Consequently, cast ingots having an intended size and corners of intended shape can be produced, with a reduced variation in the weight thereof.

Figure 21A:
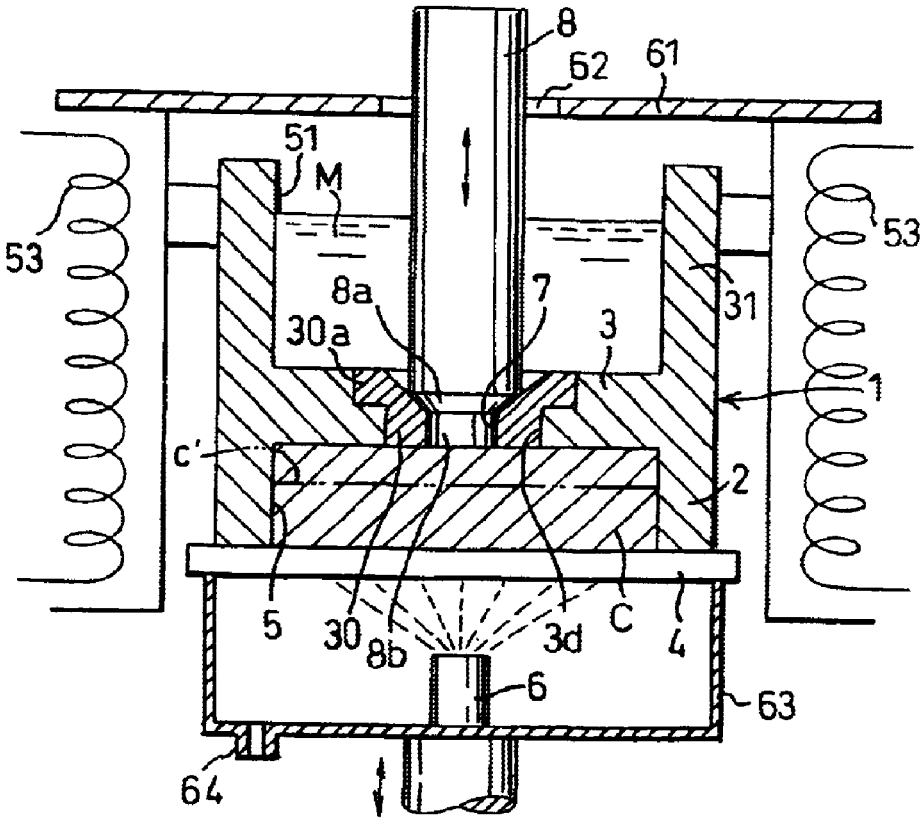
FIG. 21A is a cross-sectional view schematically showing a metal casting apparatus according to a seventh embodiment of the present invention.

FIG. 21A is a schematic representation showing a seventh embodiment of the casting apparatus according to the present invention. The casting apparatus shown in FIG. 21A is employed for producing a variety of cast bodies including metallic cast ingots which is used as stocks for plastic working, such as cool forging, hot forging, closed die forging, rolling, extrusion or rolling forming, and cast products assuming a product shape. Examples of the raw material of the cast body include steel. Preferably, the raw material of the cast body is a non-iron metal such as aluminum, zinc, magnesium or alloy thereof.

As shown in FIG. 21A, the casting apparatus has a mold 1 comprising a cooling plate 4, a side mold member 2 and an upper mold member 3 having an upper wall 31.

The cooling plate 4 is formed from a metal exhibiting excellent refractory characteristics and high thermal conductivity, such as copper or aluminium; or from a refractory material having high thermal conductivity, such as graphite, silicon carbide or trisilicon tetranitride. The cooling plate 4 has a circular plate-like shape. A case 63 and a spray nozzle 6 are provided below the cooling plate 4. The case 63 has a bottomed hollow-cylindrical shape and is provided for covering the lower surface of the cooling plate 4. The spray nozzle 6 is used for spraying cooling water from spray holes provided at its head end onto the cooling plate 4 and is attached to the case 63 such that the head end portion of the spray nozzle 6 is provided inside the case 63 and the spray holes face the lower surface of the cooling plate 4. The cooling plate 4, case 63 and spray nozzle 6 are connected to a non-illustrated lifting apparatus via the case 63 and can be moved vertically as a unit by operating the lifting apparatus.

The upper mold member 3 assumes a disk shape and has a diameter slightly smaller than that of the cooling plate 4. The hollow cylindrical side mold member 2 is provided on the peripheral portion of the lower surface of the upper mold member 3, and the hollow cylindrical upper wall 31 is provided on the peripheral portion of the upper surface of the upper mold member 3. The side mold member 2, upper mold member 3 and upper wall 31 are integrally fixed above the cooling plate 4. When the cooling plate 4 is moved downward, the bottom of the side mold member 2 opens. When the cooling plate 4 is moved upward, the bottom of the side mold member 2 is covered with the cooling plate 4, and a casting chamber 5 is defined by the upper mold member 3, side mold member 2 and cooling plate 4. In consideration of the raw material of a cast body C to be produced, wettability of molten metal M with respect to the mold 1, temperature during use of the mold, corrosion resistance of the mold, etc., the material of the mold 1 may be appropriately selected from among a heat-insulating refractory material predominantly containing calcium silicate, calcium oxide, silicon dioxide, aluminum oxide or magnesium oxide; a refractory material such as silicon nitride, trisilicon tetranitride, trisilicon tetranitride containing boron nitride, silicon carbide, graphite, boron nitride, titanium dioxide, zirconium oxide, aluminum nitride or a mixture thereof; and a metal such as iron or copper. A passage (not shown in FIG. 21) for discharging air in the casting chamber 5 to the outside during teeming of the molten metal is preferably provided at an appropriate position of the mold 1.

A member 30 having a sprue-defining wall is provided at the center of the upper mold member 3 of the mold 1. The member 30 has a hollow cylindrical shape and includes a flange 30*a* on its upper periphery. The member 30 is removably provided in a hole 3*d* formed in the upper mold member 3 such that the lower surface of the member 30 is made flush with the lower surface of the upper mold member 3. The inner wall of the member 30 defines a sprue 7 around the center axis of the member 30. The sprue 7 has a lower end portion with a uniform inner diameter and an upper end portion with an inner diameter gradually increasing upward that has a sloped inner surface. The angle of elevation of the slope is 15–75°, preferably 30–60°. When the angle of of elevation of the slope is less than 15°, smoothness is lowered between the sloped surface and a tapered portion 8*a* of an opening/closing plug 8 that will be described later. If the angle of elevation of the slope is in excess of 75°, when the diameter of a fitting portion 8*b* of the plug 8 remains unchanged, the outer diameter of the plug 8 becomes small, and thus the plug 8 encounters difficulty in maintaining satisfactory strength. Similarly to the case of the mold 1, in consideration of the raw material of the cast body C to be produced, wettability of the molten metal M with respect to the member 30, temperature during use of the member 30, corrosion resistance of the member 30, etc., the material of the member 30 may be appropriately selected from among a heat-insulating refractory material predominantly containing calcium silicate, calcium oxide, silicon dioxide, aluminum oxide or magnesium oxide; a refractory material such as silicon nitride, trisilicon tetranitride, trisilicon tetranitride containing boron nitride, silicon carbide, graphite, boron nitride, titanium dioxide, zirconium oxide, aluminum nitride or a mixture thereof; and a metal such as iron or copper. In the seventh embodiment, the mold 1 and the member 30 having the sprue-defining wall are formed from silicon carbide, and a mold-releasing agent containing 5% water glass is applied onto a junction surface at which the mold 1 and the member 30 are fitted with each other. The position at which the member 30 is disposed, i.e. the position of the sprue 7, is not necessarily the center of the upper mold member 3, and the position may be determined in accordance with the shape of a cast body to be produced.

The opening/closing plug 8 assumes a columnar shape having a diameter larger than that of the lower end portion of the sprue 7 and smaller than that of the upper end portion of the sprue 7. The opening/closing plug 8 has, at its lower end portion, the tapered portion 8*a* and the fitting portion 8*b*. The outer diameter of the tapered portion 8*a* is gradually decreased downward. The fitting portion 8*b* assumes a columnar shape having a size such that the potion 8*b* is fitted into the lower end portion of the sprue 7. The opening/closing plug 8 is vertically movably provided while the center axis of the plug 8 is coincident with that of the sprue 7. The plug 8 can be moved vertically by operating a non-illustrated plug-driving apparatus. The plug 8 is preferably formed from a heat-insulating refractory non-metallic material having high mechanical strength, such as silicon carbide, trisilicon tetranitride or a mixture thereof. The plug 8 may be formed from a metallic material having no or little reactivity with the molten metal M, such as iron or cast steel.

In FIG. 21A, reference numeral 61 represents an upper lid for covering the region above the mold 1, and reference numeral 53 represents an electric furnace connected to the upper wall 31 of the mold 1.

When the cast body C is produced by use of the casting apparatus having the aforementioned structure, firstly, the cooling plate 4 is moved upward by means of the lifting apparatus to allow it to define the casting chamber 5 in conjunction with the side mold member 2 and upper mold member 3. The opening/closing plug 8 is moved downward by means of the plug driving apparatus, and the fitting portion 8*b* of the plug 8 is fitted into the lower end portion of the sprue 7. Furthermore, the tapered portion 8*a* of the plug 8 may be abutted against the sloped surface of the sprue 7.

In this configuration, the sprue 7 is closed by means of the plug 8. Thus, a molten metal reservoir 51 provided above the upper mold member 3 and defined by the upper wall 31 and the casting chamber 5 are disconnected from each other. A mold-releasing agent is preferably applied onto the surface of the mold 1 defining the casting chamber 5 in order to facilitate removal of the cast body C from the mold 1. In addition, a mold-releasing agent is preferably applied onto the opening/closing plug 8 in order to prevent reaction between the plug 8 and the molten metal M.

Subsequently, the electric furnace 53 is operated, and then a predetermined amount of the molten metal M is fed into the reservoir 51. The electric furnace 53 is operated in order to maintain the molten metal M in the reservoir 51 at a predetermined temperature and prevent the molten metal from being cooled by the side mold member 2 to enhance the effect of unidirectional solidification that will be described later.

Subsequently, the plug 8 is moved upward by means of the plug-driving apparatus to remove the fitting portion 13*b* thereof from the lower end portion of the sprue 7.

At this stage, the sprue 7 is opened, and thus the reservoir 51 and the sprue 7 are brought into communication. Therefore, the molten metal M stored in the reservoir 51 is sequentially teemed into the casting chamber 5 through the sprue 7, and the casting chamber 5 is filled with the molten metal M. When the plug 8 is moved upward, the cooling plate 4 is preferably heated to at least 100° C. When the temperature of the cooling plate 4 is lower than 100° C., a "blow defect," a kind of casting defect, is formed, which is not preferable. The upper limit of the temperature of the cooling plate 4 is preferably equal to the temperature of the molten metal M. Furthermore, in order to prevent formation of the "blow defect," a mold-releasing agent is preferably applied onto the cooling plate 4 in advance.

After the casting chamber 5 is fully filled with the molten metal M, the sprue 7 is closed by moving the plug 8 downward, and then cooling water is sprayed from the spray nozzle 6 onto the cooling plate 4. When cooling water is sprayed onto the cooling plate 4, the molten metal M in the casting chamber 5 is sequentially solidified unidirectionally from the lower portion of the casting chamber 5 to the upper portion thereof. As described above, the mold 1 and the member 30 having the sprue-defining wall are formed from silicon carbide. Therefore, as shown by a dashed and two-dotted line in FIG. 21A, the solidification interface (boundary surface between the molten metal and the solidified metal) c' becomes parallel to the upper surface of the cooling plate 4 and has a flat continuous surface, and the molten metal is solidified such that the solidification interface c' gradually moves upward. Following the solidification of the molten metal M into the cast body C in the casting chamber 5, the cooling plate 4 is moved downward with respect to the side mold member 2, and the cast body C placed on the upper surface of the cooling plate 4 is removed from the cooling plate 4.

Since the cast body C is produced through unidirectional solidification such that the flat continuous solidification interface c' is formed, the cast body C is of good quality. That is to say, the cast body C does not have defects such as casting cavities, shrinkage cavities, pinholes, and invasion of oxides. Furthermore, since the upper portion of the casting chamber 5 is closed by the side mold member 2 in conjunction with the lower end surface of the plug 8, a consistent amount of molten metal can be teemed into the casting chamber 5 even if the amount of the molten metal is not measured. In addition, a meniscus portion of the molten metal is not greatly curved, and a variation in size and weight between the cast bodies C does not become large. Spraying of cooling water from the spray nozzle 6 onto the cooling plate 4 is not necessarily carried out after the sprue 7 is closed with the plug 8. Cooling water may be sprayed from the nozzle 6 onto the cooling plate before the sprue 7 is closed with the plug 8, i.e. during teeming of the molten metal M from the reservoir 51 into the casting chamber 5. When the thickness of the cast body C is large, the cooling plate 4 may be moved downward during cooling, and cooling water may be sprayed directly onto the bottom surface of the cast body C.

In the casting apparatus, the member 30 having a wall defining the sprue 7 is separable from the upper mold member 3 of the mold 1, and the member 30 having the sprue-defining wall is removably provided on the upper mold member 3. Therefore, the member 30 can be handled as a single member of relatively small size. Similarly to the member 30, the plug 8 can be handled as a single member. Therefore, very high dimensional accuracy of the sprue 7 and plug 8 on the order of 1/100 mm can be attained without involving considerably high production costs or troublesome labor. Even when the member 30 and plug 8 are formed from different materials, and the thermal expansion coefficients of the member 30 and plug 8 are different from each other, fitting accuracy between the member 30 and the plug 8 can in practice be verified and regulated during the operation by heating the member 30 and plug 8 to a temperature equal to the molten metal. Therefore, further high dimensional accuracy of the sprue 7 and plug 8 can be easily attained. Consequently, when the plug 8 is moved downward, the fitting portion 8*b* is brought into tight contact with the inner wall of the lower end portion of the sprue 7, and leakage of the molten metal M from the reservoir 51 into a space between the plug 8 and the sprue 7 can be effectively prevented. As a result, formation of casting burrs on the cast body C can be prevented, and the cast body C can be very smoothly removed from the mold 1, resulting in no casting problem. A forged product formed from the cast body does not have defects otherwise arising from folded and/or stamped burrs. In addition, when the plug 8 is moved downward, the lower end surface of the plug 8 is made precisely flush with the lower surface of the upper mold member 3, there can be prevented formation of a protuberant or dented portion on the cast body C, that is attributed to a step formed between the plug 8 and the upper mold member 3. During the operation of the casting apparatus, the difference in diameter between the plug 8 and the sprue-defining wall of the member 30 is 0.10 mm or less, preferably 0.06 mm or less.

Since the member 30 having the sprue-defining wall can be handled as a single member, the casting apparatus has advantages in terms of maintenance and control, as described below.

Firstly, when the member 30 having the sprue-defining wall is worn as a result of prolonged use, or when the member 30 is deformed or broken through collision by the plug 8, the worn or broken member 30 can be removed from the mold 1 and exchanged with a new member without involving removal of other members. Therefore, costs required for maintenance of the casting apparatus of the present invention can be considerably reduced as compared with a conventional casting apparatus that requires an overall mold to be exchanged when such a member is broken.

Secondly, when a cast body including portions of different shapes is produced, costs required for producing the cast body and a space in which the mold 1 is stored can be reduced. For example, as in the case of a casting apparatus according to a eighth embodiment shown in FIG. 22, when a projection portion 30*b* is provided on a member 30A having a wall defining a sprue 7, even if the same mold 1 is used, a cast body C1 differing in shape from the cast body C can be produced by exchanging the member 30 having the sprue-defining wall according to the seventh embodiment with the member 30A having the projection portion 30*b*. Therefore, costs for producing the mold can be greatly reduced, and the space for storing one mold will suffice. In the eighth embodiment, identical reference numerals are assigned to those members of the casting apparatus that are identical with those of the casting apparatus according to the seventh embodiment, and the detailed description of the members is omitted.

Figure 23:
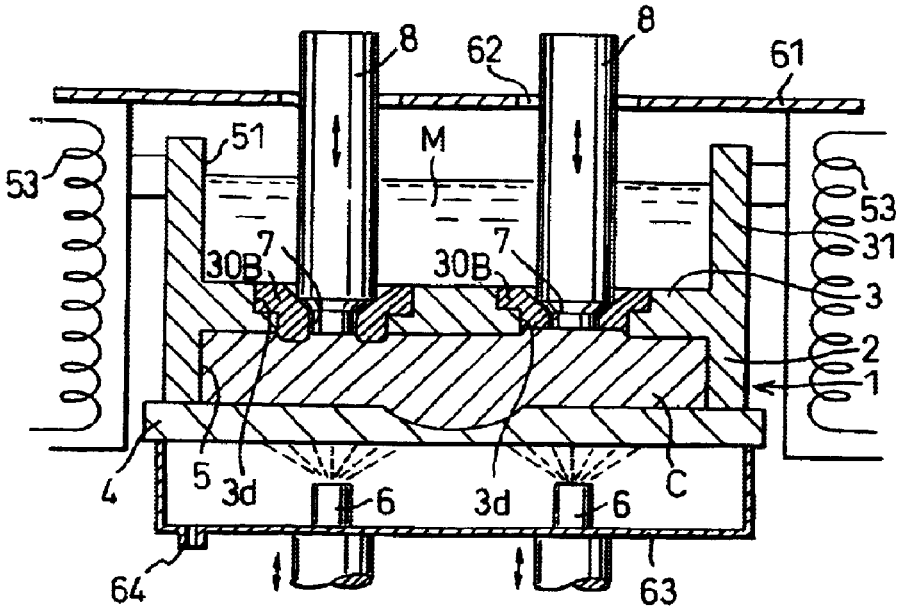
FIG. 23 is a cross-sectional view schematically showing a metal casting apparatus according to a ninth embodiment of the present invention.

The aforementioned effects of the present invention are particularly exerted in a casting apparatus of relatively large size according to a ninth embodiment shown in FIG. 23 that includes a plurality of sprues 7. When a plurality of members 30B each having a wall defining a sprue 7 are provided, even if the mold 1 is of large size, each member 30B having the sprue-defining wall can be handled as a single member, each sprue 7 can be subjected to working under the same conditions as those in the seventh and eighth embodiments, and high dimensional accuracy of each sprue 7 can be attained. When one of the plural members 30B is broken, only the broken member 30B is exchanged with a new member, with the remaining member(s) 30B left intact. Therefore, the mold 1 and the remaining member(s) 30B can be used continuously, and thus operation costs of the casting apparatus can be greatly reduced. As in the case of the ninth embodiment, when a plurality of the members 30B are provided in the mold 1, the members 30B may be of identical or different materials. When a plurality of sprues are provided in the mold, it is not necessarily required that each of the members 30B includes one sprue, and one of the members 30B may include a plurality of sprues 7. In the ninth embodiment, identical reference numerals are assigned to those members of the casting apparatus that are identical with those of the casting apparatus according to the seventh embodiment, and the detailed description of the members is omitted.

The seventh, eighth and ninth embodiments employ the molds 1 including the members 30, 30A and 30B fitted into the holes 3*d*, respectively. In the present invention, a member having a sprue-defining wall may be provided on a mold by means of another method, as in the case of a casting apparatus according to a tenth or eleventh embodiment, for example. In the casting apparatus according to the fourth embodiment shown in FIG. 24, A screw thread 3*e* is formed on the inner wall of the hole 3*d* formed in the mold 1, a screw thread 30*c* is formed on the peripheral wall of a member 30C having a wall defining a sprue 7, and the member 30C is detachable attached to the hole 3*d* by means of the screw engagement. In the casting apparatus according to the eleventh embodiment shown in FIG. 25, the upper wall 31 having at its lower portion a fixing portion 12*f* is separable from the mold 1. A member 30D having a wall defining a sprue 7 is fitted into the hole 3*d* of the mold 1 and sandwiched by the hole 3*d* and the fixing portion 12*f*. In the casting apparatus according to the tenth and eleventh embodiments, the aforementioned effects are obtained, and falling of the member 30C or 30D from the mold 1 can be obviated, and thus the casting operation can be carried out smoothly and reliably. In the tenth and eleventh embodiments, identical reference numerals are assigned to those members of the casting apparatus that are identical with those of the casting apparatus according to the seventh embodiment, and the detailed description of the members is omitted.

The seventh through eleventh embodiments employ the members 30, 30A, 30B, 30C and 30D, respectively, each having a size smaller than that of the upper surface of the casting chamber 5. However, the present invention is not limited to this point. For example, as in the case of a twelfth embodiment shown in FIG. 26, the size of a member 30E having a wall defining a sprue 7 may be larger than that of the upper surface of the casting chamber 5. In the casting apparatus according to the twelfth embodiment, the aforementioned effects are obtained, and a connection line formed between the mold 1 and the member 30E is not transferred onto a cast body C, and thus a cast body C of high quality can be produced. In the casting apparatus according to the twelfth embodiment, the member 30E has a generally rectangular shape. However, the shape of the member 30E is arbitrary. Even if the member 30E has a columnar shape similar to those employed in the seventh through eleventh embodiments, when the size of the member 30E is larger than that of the casting chamber 5, the same effects as described above can be expected. In the twelfth embodiment, identical reference numerals are assigned to those members of the casting apparatus that are identical with those of the casting apparatus according to the seventh embodiment, and the detailed description of the members is omitted.

In the seventh through twelfth embodiments, each of the members 30, 30A, 30B, 30C, 30D and 30E is attached into the hole 3*d* formed in the mold 1. However, the present invention is not limited to this point. For example, as in the case of a thirteenth embodiment shown in FIG. 27, a member 30F having a wall defining a sprue 7 and including the integral upper wall 31 may be removably provided on the upper surface of the upper mold member 3. The lower surface of the member 30F and the upper surface of the upper mold member 3 are subjected to polishing by use of abrasive stone or a lathe so as to enhance adhesion between the member 30F and the upper mold member 3. The flatness of the polished surface is 0.2 mm or less, preferably 0.1 mm or less. The surface roughness (Rz) of the polished surface is 0.5 mm or less, preferably 0.1 mm or less. When the member 30F is attached onto the upper surface of the upper mold member 3, means for facilitating determination of the mutual positions of the upper mold member 3 and the member 30F is preferably provided. For example, as in the case of the casting apparatus according to the thirteenth embodiment, a counter-notch portion 3*f* is provided on the upper peripheral portion of the upper mold member 3, and a notch portion 3*g* is provided on the lower peripheral portion of the member 30F, and the counter-notch portion 3*f* is fitted into the notch portion 3*g*, to thereby determine the positions of the upper mold member 3 and the member 30F. In this case, the counter-notch portion and notch portion may be provided conversely, or each of the upper mold member 3 and the member 30F may have both a counter-notch portion and a notch portion. Such a counter-notch portion is not necessarily an integral protrusion formed on the upper mold member 3 or the member 30F, and a locating pin may be provided as a counter-notch portion on the upper mold member 3 or the member 30F.

In the seventh through thirteenth embodiments, the mold 1 and the members 30, 30A, 30B, 30C, 30D, 30E and 30F are formed from silicon carbide. The mold and each of the members having the sprue-defining wall may be of identical or different materials. Conditions for determining a combination of the materials of the mold and each of the members having the sprue-defining wall will be described.

(1) Combination of materials in consideration of thermal conductivity:

In the casting apparatus as described above, in consideration of the inside quality of a produced cast body, unidirectional solidification is preferably carried out such that the flat, continuous solidification interface is formed.

Figure 21B:
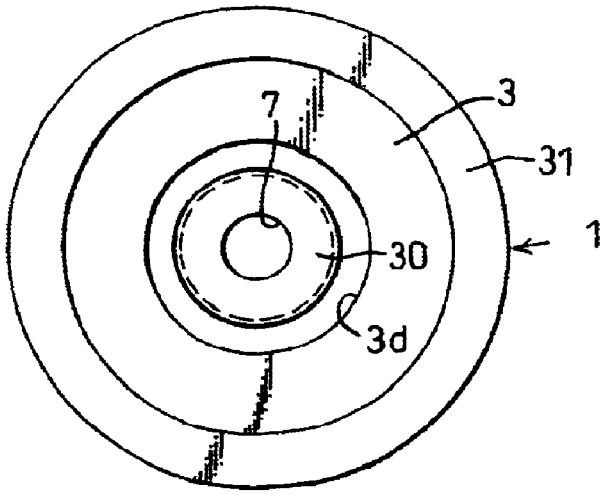
FIG. 21B is a plan view of a mold of the apparatus.
Figure 22:
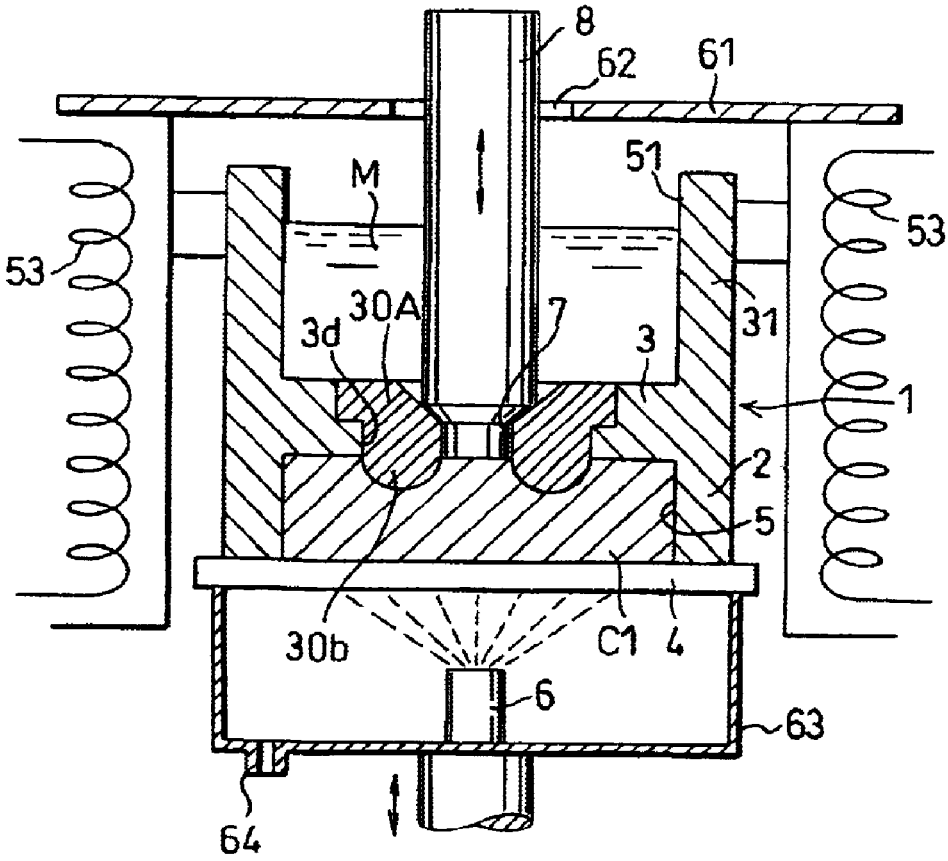
FIG. 22 is a cross-sectional view schematically showing a metal casting apparatus according to an eighth embodiment of the present invention.
Figure 24:
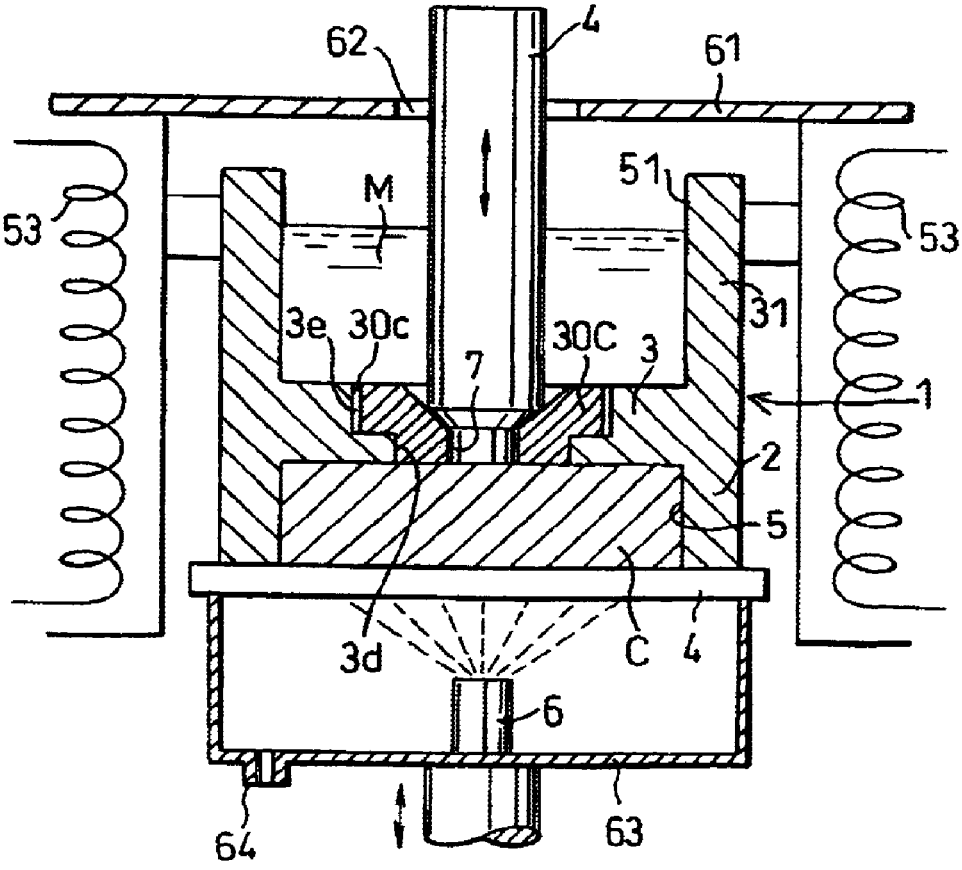
FIG. 24 is a cross-sectional view schematically showing a metal casting apparatus according to a tenth embodiment of the present invention.
Figure 25:
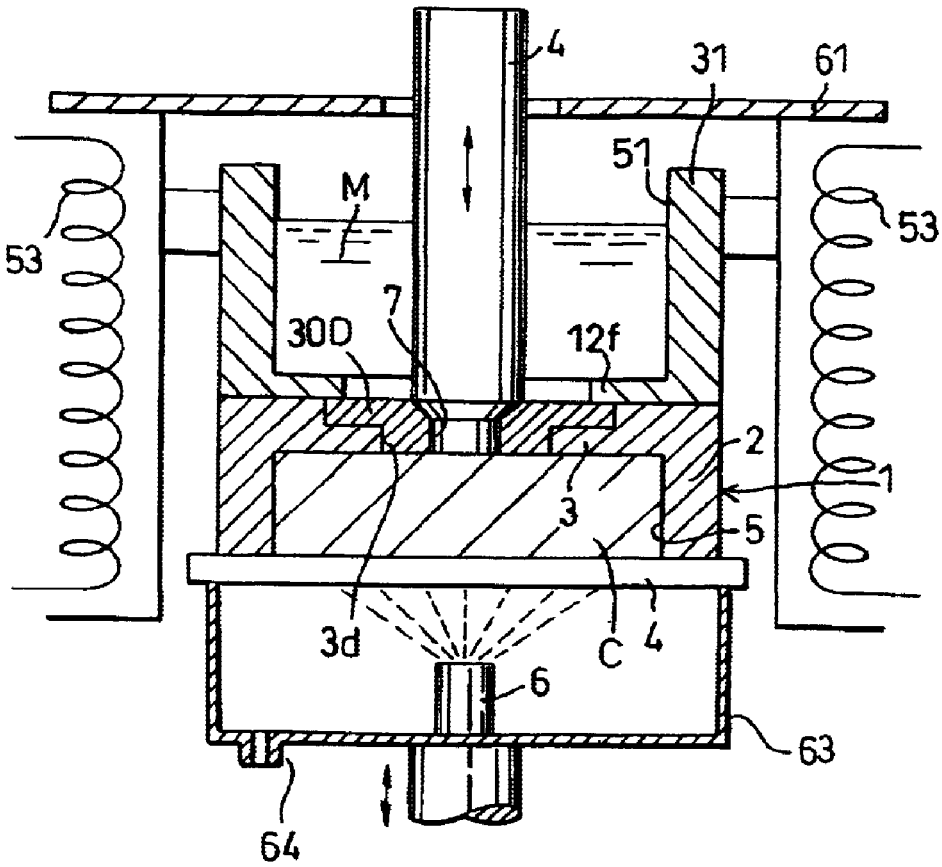
FIG. 25 is a cross-sectional view schematically showing a metal casting apparatus according to an eleventh embodiment of the invention.
Figure 26A:
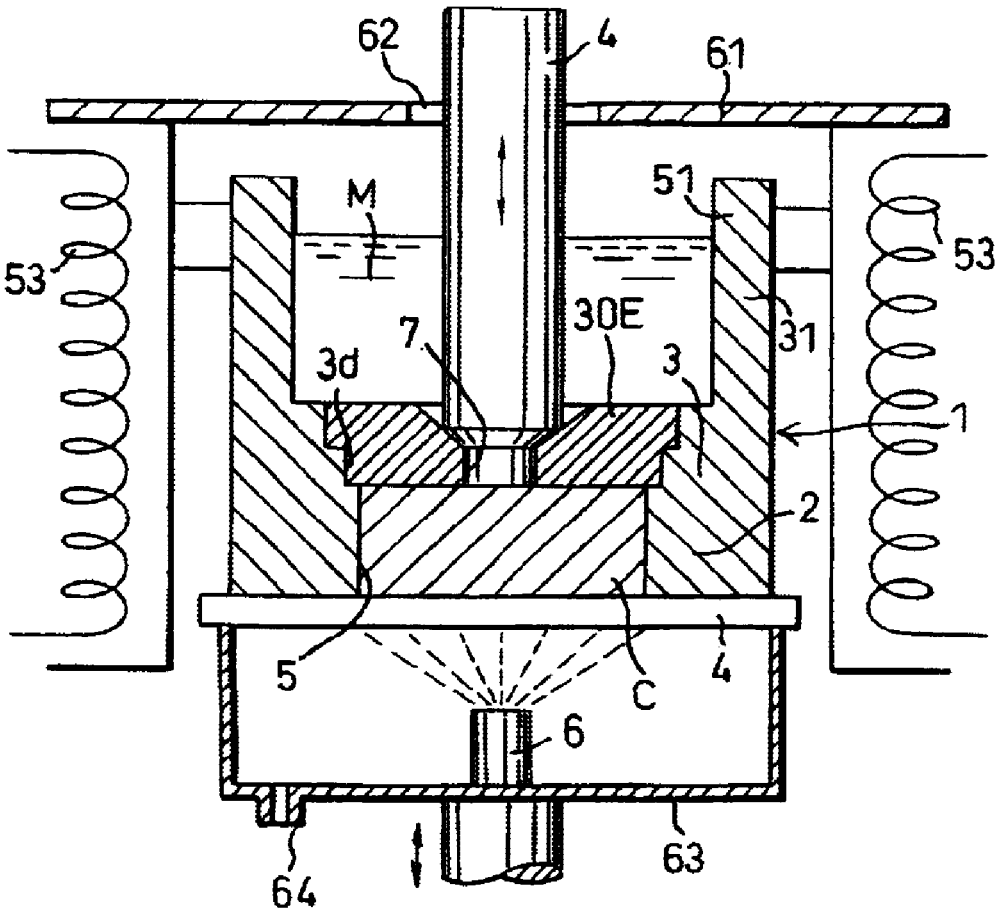
FIG. 26A is a cross-sectional view schematically showing a metal casting apparatus according to a twelfth embodiment of the present invention.
Figure 26B:
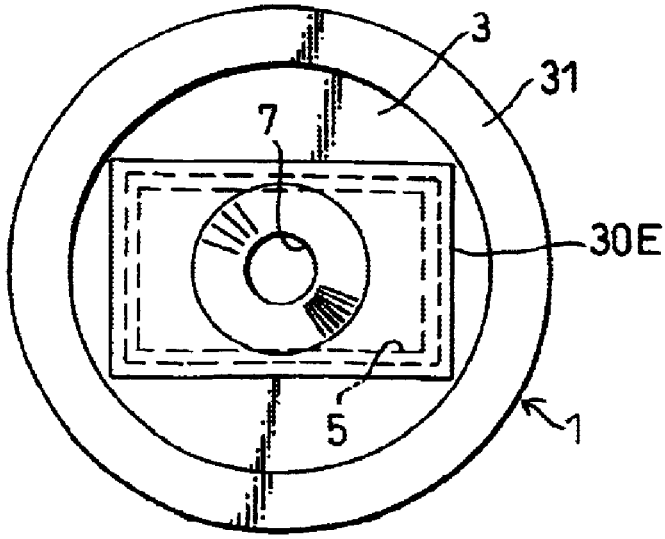
FIG. 26B is a plan view of a mold of the apparatus.
Figure 27:
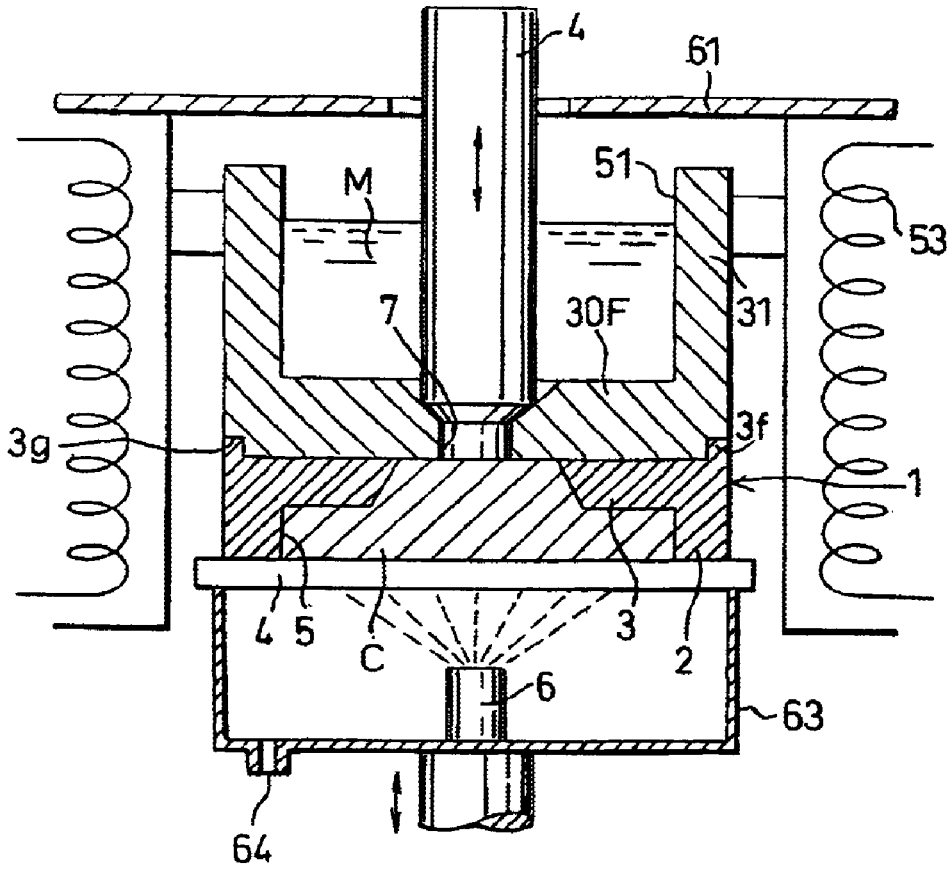
FIG. 27 is a cross-sectional view schematically showing a metal casting apparatus according to a thirteenth embodiment of the present invention.

Therefore, when the cast bodies C are of uniform thickness as shown in FIGS. 21, 24 and 25, for example, the mold and the members having the sprue-defining wall are preferably formed from materials of identical thermal conductivity. The materials of the mold and the members are not necessarily silicon carbide, and may be appropriately selected from among the aforementioned examples of materials. For example, the mold and the members may be formed from Lumiboard. The "Lumiboard" is produced by Nichias Corporation and consists predominantly of calcium silicate.

Figure 28:
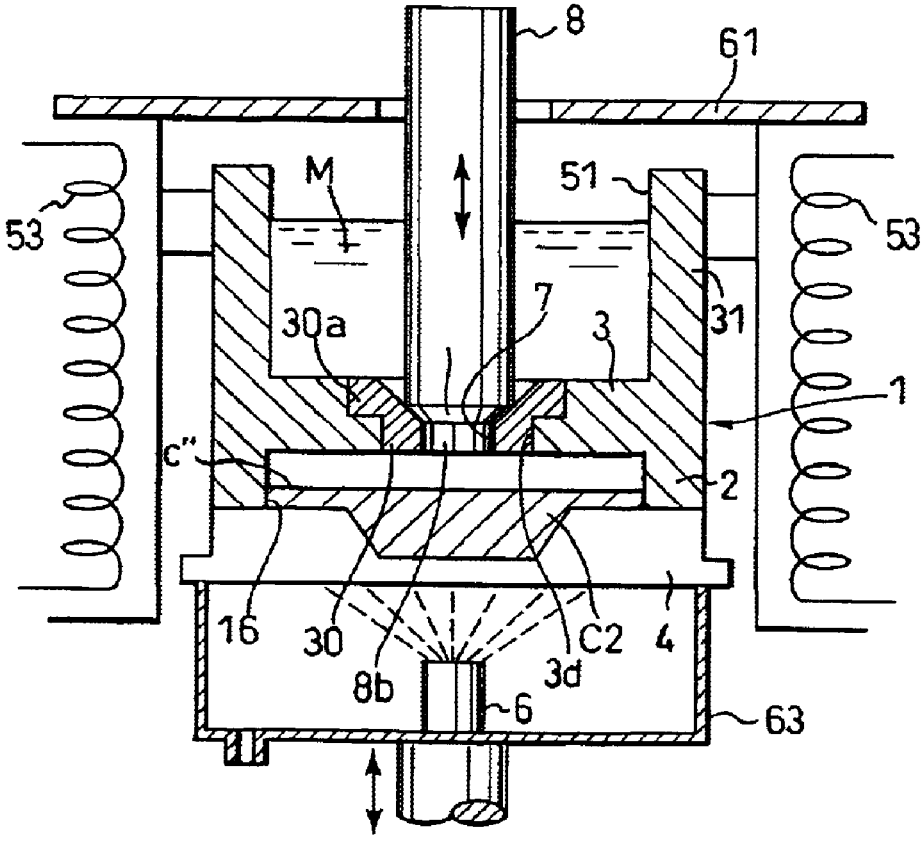
FIG. 28 is a cross-sectional view schematically showing a metal casting apparatus according to a fourteenth embodiment of the present invention.

In contrast, as shown in FIG. 28, in a casting apparatus for producing a cast body C2 having a large thickness at a portion below a sprue 7, the portion of the cast body below the sprue 7 is prone to slow solidification. Therefore, when the mold 1 and the member 30 having the sprue-defining wall are formed from materials of identical thermal conductivity, there is a possibility of the solidification interface failing to be flat and continuous.

Therefore, in the case of the casting apparatus shown in FIG. 28, the member 30 having the sprue-defining wall is formed from a material having a thermal conductivity lower than that of the material of the mold 1. When the member 30 is formed from a material having a low thermal conductivity, the flow rate of heat from the molten metal M stored in the reservoir 51 is lowered in the member 30 as compared with the mold 1, the entirety of the cast body C2 is solidified uniformly, and thus the solidification interface c" becomes flat. Specifically, when the mold 1 is formed from silicon carbide (thermal conductivity=75.1 W/mk), the member 30 is formed from trisilicon tetranitride (thermal conductivity=17.4 W/mk). When the mold 1 is formed from trisilicon tetranitride, the member 30 is formed from Lumiboard (thermal conductivity=0.2 W/mk).

Figure 29:
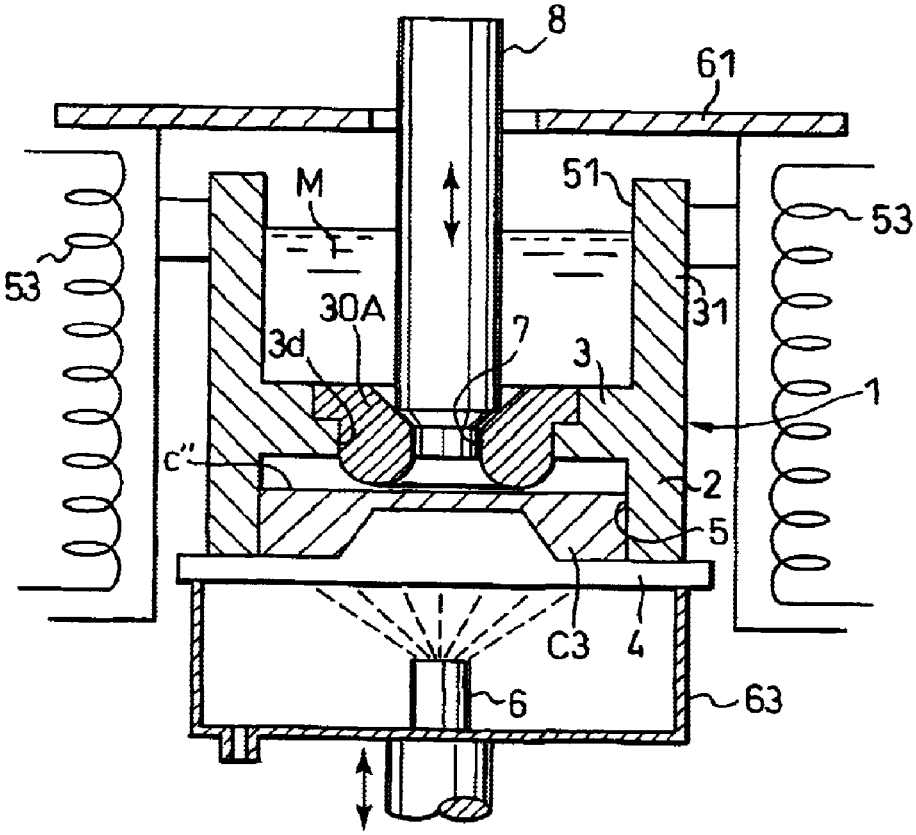
FIG. 29 is a cross-sectional view schematically showing a metal casting apparatus according to a fifteenth embodiment of the present invention.
Figure 30:
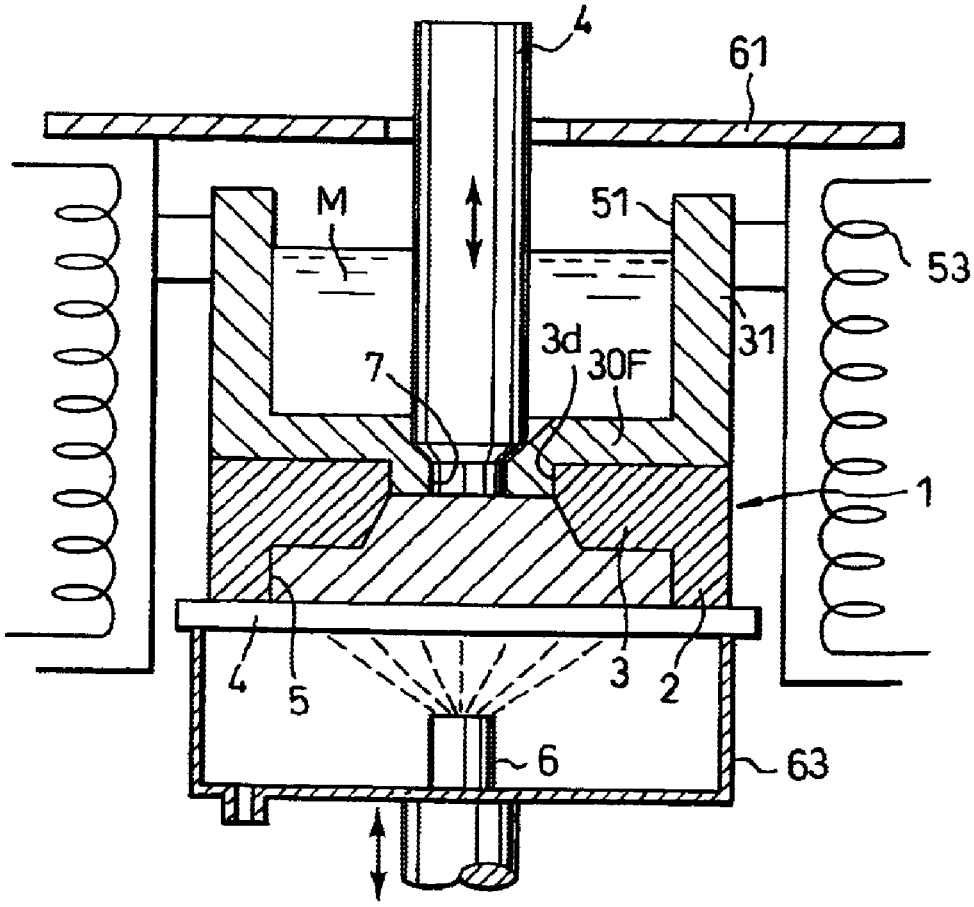
FIG. 30 is a cross-sectional view schematically showing a metal casting apparatus according to a sixteenth embodiment of the present invention.

As shown in FIG. 29, in a casting apparatus for producing a cast body C3 having a small thickness at a portion below a sprue 7, the portion of the cast body below the sprue 7 is solidified quickly. Therefore, the member 30A having the sprue-defining wall is formed from a material having a thermal conductivity higher than that of the material of the mold 1. When the member 30A is formed from a material having a high thermal conductivity, the flow rate of heat from the molten metal M stored in the reservoir 51 is increased in the member 30A as compared with the mold 1, the entirety of the cast body C3 is solidified uniformly, and thus the solidification interface c" becomes flat. Specifically, when the mold 1 is formed from trisilicon tetranitride, the member 30A is formed from graphite (thermal conductivity=167.0 W/mk). When the mold 1 is formed from aluminum titanate (thermal conductivity=1.2 W/mk), the member 30A is formed from silicon carbide.

(2) Combination of materials in consideration of thermal expansion coefficient:

When a casting apparatus is assembled, a member having a sprue-defining wall is attached to a hole of a mold at room temperature. However, in practice, during the casting operation, the temperature of the mold and the member having a sprue-defining wall becomes high. For example, when casting is carried out using an aluminum alloy as a raw material, the temperature of the mold and the member having a sprue-defining wall reaches as high as 660° C. Particularly, in a casting apparatus in which a member having a sprue-defining wall is attached to a hole of a mold, when the thermal expansion coefficient of the member having a sprue-defining wall is higher than that of the mold, excess force is applied to the mold during the casting operation. This may damage the mold. Therefore, in such a casting apparatus in which a member having a sprue-defining wall is attached to a hole of a mold, the member having a sprue-defining wall is preferably formed from a material having a thermal expansion coefficient lower than that of the material of the mold.

In the casting apparatus shown in FIG. 21, for example, when the mold is formed from silicon carbide (thermal expansion coefficient=$4.2\times10^{-6}$/° C.), the member having a sprue-defining wall is formed from trisilicon tetranitride (thermal expansion coefficient=$3.2\times10^{-6}$/° C.). In a casting apparatus shown in FIG. 30, when a mold 1 is formed from stainless steel (SUS: thermal expansion coefficient=$17.3\times10^{-6}$/° C.), a member 30F having a sprue-defining wall is formed from trisilicon tetranitride. In the casting apparatus shown in FIG. 24, when the mold 1 is formed from Sialon (thermal expansion coefficient=$3.1\times10^{-6}$/° C.), the member 30C having a sprue-defining wall is formed from graphite (thermal expansion coefficient=$2.0\times10^{-6}$/° C.). The "Sialon" is produced by Hitachi Metals, Ltd. and consists predominantly of a mixture of aluminum oxide and silicon nitride. In practice, casting was carried out using the casting apparatus shown in FIG. 21 in which the member 30 having a sprue-defining wall was fitted into the hole 3*d* having an inner diameter of 30 mm, the difference in diameter between the member 30 and the hole 3*d* being 0.1 mm. As a result, there arose no problem attributed to the difference in thermal expansion coefficient between the member 20 and the hole 3*d* during use of the casting apparatus. Furthermore, casting was carried out using the casting apparatus shown in FIG. 30 in which the member 30F having an inlet-defining wall was fitted into the hole 3*d* having an inner diameter of 40 mm, the difference in diameter between the member 30F and the hole 3*d* being 0.05 mm. As a result, no problem arose during use of the casting apparatus. In addition, casting was carried out using the casting apparatus shown in FIG. 24 in which the screw threads 3*a* and 30*c* (M40-pitch: 2 mm) were formed on the hole 3*d* of the mold 1 and the member 30C having a sprue-defining wall, respectively, and the member 30C was screwed into the hole 3*d*. As a result, no problem arose during use of the casting apparatus.

(3) Combination of materials in consideration of bending strength:

When the inner wall or the sloped surface of a member having a sprue-defining wall is worn, deformed or damaged through the opening/closing operation of an opening/closing plug, the plug does not operate well, and molten metal leaks through a space between the plug and the member having a sprue-defining wall, since the plug is not tightly fitted into the member. In order to prevent such wear, deformation or damage, a material of high bending strength is preferably used. However, workability of such a material is poor, and thus costs required for working increases. Therefore, in the aforementioned casting apparatus, the member having a sprue-defining wall brought into direct contact with the plug is preferably formed from a material having a bending strength higher than that of the material of the mold to thereby reduce the frequency of occurrence of the wear, deformation or damage. Particularly, in the casting apparatus shown in FIG. 22 or FIG. 29, the member 30A having a sprue-defining wall is preferably formed from a material having sufficiently high bending strength and excellent durability, since the member 30A has a complicated shape as compared with those included in the other casting apparatus of the present invention. The opening/closing plug brought into contact with the member 30A having a sprue-defining wall is preferably formed from a material having a bending strength lower than that of the material of the member 30A. In the casting apparatus shown in FIG. 22 or FIG. 29, for example, when the mold 1 is formed from graphite (bending strength=14.7 MPa), the member 30A having a sprue-defining wall is formed from trisilicon tetranitride (bending strength=392.0 MPa), and the opening/closing plug 4 is formed from Lumiboard (bending strength=5.2 MPa).

EXAMPLE

A casting apparatus shown in FIG. 21 was formed using a mold 1 formed from silicon carbide and a member 30 having a sprue-defining wall formed from trisilicon tetranitride. By use of the casting apparatus, a cast body C having an outer diameter of 65 mm and a thickness of 10 mm was formed from JIS 2218 aluminum alloy.

The mold 1 has an outer diameter of 130 mm and a height of 200 mm. The upper mold member 3 has a thickness of 30 mm. The hole 3*d* has an inner diameter of 80 mm at the upper portion, an inner diameter of 40 mm at the lower portion and an upper portion height of 15 mm. The surface of the upper mold member 3 defining the casting chamber 5 was subjected to diamond polishing by use of an abrasive plate to thereby obtain desired flatness.

The member 30 having the sprue-defining wall has a height of 30 mm and includes at its upper portion a flange 30*a* such that the member is fitted into the hole 3*d* of the upper mold member 3. The sprue 7 has an inner diameter of 12 mm and has at its upper portion a sloped surface that is sloped at 45°. Before being subjected to firing, the member 30 was roughly profiled with a lathe. After being fired, the member 30 was subjected to precise polishing using a lathe, an NC milling machine and an abrasive plate. Particularly, the sprue 7 was subjected to polishing using a lathe and an NC milling-abrasive machine so as to attain a tolerance in diameter of ±0.02 mm. When the opening/closing plug 8 was fitted into the member 30, the difference in diameter between the plug 8 and the sprue 7 with the inner diameter of 12 mm was 0.04 mm.

The processing machine and jig used for polishing the member 30 were of small size, and thus the time required for setup of such tools or for polishing the member 30 was shortened, and production cost was relatively low.

In the manufacture of cast bodies C, in substantially 100% of cases, the cast bodies fell spontaneously from the mold 1, and no problem occurred during the operation of the casting apparatus, since the dimensional accuracy of the member 30 and the opening/closing plug 8 was high and leakage of molten metal into a space between the member 30 and the plug 8 was prevented reliably. The resultant cast body C did not have defects on the surface. Therefore, when the as-produced cast body was subjected to forging by use of a forging unit, the forged product did not have defects arising from folded and/or stamped burrs.

COMPARATIVE EXAMPLE

A cast body having an outer diameter of 65 mm and a thickness of 10 mm was produced from JIS 2218 aluminum alloy using a casting apparatus similar to that employed in the Example. In the casting apparatus of Comparative Example, as shown in FIG. 32, the sprue 7 is provided directly in the upper mold member 3. The mold 1 is formed from silicon carbide.

The mold 1 has an outer diameter of 130 mm and a height of 200 mm. The upper mold member 3 has a thickness of 30 mm. The surface of the mold 1 defining the casting chamber 5 was subjected to diamond polishing by use of an abrasive plate to thereby obtain desired flatness. The sprue 7 has an inner diameter of 12 mm and has at its upper portion a sloped surface that is sloped at 45°. The sprue 7 was subjected to polishing by use of a large-sized NC milling-abrasive machine and a large-sized lathe that can support the mold 1. However, since the mold 1 having an outer diameter of as large as 130 mm was supported, rigidity was insufficient, and an accuracy corresponding to tolerance in diameter within a range of ±0.2 mm could not be attained. When the opening/closing plug 8 was fitted into the sprue 7, the difference in diameter between the plug 8 and the sprue 7 with an inner diameter of 12 mm was 0.4 mm.

The processing machine and jig used for polishing the mold 1 were of large size, and thus the time required for setup of such tools or for polishing the mold 1 was about twice the setup time or the polishing time in the Example, and production cost was greatly increased.

In the manufacture of cast bodies C, only in 72% of cases, the cast bodies fell spontaneously from the mold 1, since the dimensional accuracy of the sprue 7 and the opening/closing plug 8 was low, and leakage of molten metal into a space between the sprue 7 and the plug 8 was insufficiently prevented. The cast body C that did not fall spontaneously from the mold 1 had to be removed by subjecting the lower surface of the cast body C to suction by use of a vacuum suction apparatus that was introduced into the casting apparatus.

As is apparent from the aforementioned results, the casting apparatus of the Example is excellent as compared with that of the Comparative Example in terms of working accuracy and working cost.

Meanwhile, the costs required for exchange of the members 30, 30A, 30B and 30F having an sprue-defining wall of the casting apparatus according to the seventh, eighth, ninth and thirteenth embodiments shown in FIGS. 21, 22, 23 and 27 were 20/100, 10/100, 1/100 and 15/100, respectively, with respect to the cost required for exchange of the mold 1 of the casting apparatus shown in FIG. 32.

Each of the casting apparatus according to the seventh through thirteenth embodiments is for producing a cast body having a disk shape. However, the present invention can be applied to a casting apparatus for producing a cast body having another shape including a three-dimensionally profiled cast body, for example.

In a casting apparatus according to a fourteenth embodiment of the present invention, shown in FIG. 31, a side mold member 2 comprises an upper section 22 with a through-hole 22*a* and a lower section 21 with a through-hole 21*a* having a shape different from that of the through-hole 22*a*, similarly to the first or second embodiment. A cast body having an optional shape can be produced with ease if the shapes of the through-holes 21*a* and 22*a* of the divided sections 21 and 22 are optionally selected.

In the casting apparatus, the side mold member 2 is horizontally divided into the upper section 22 and the lower section 21. As described in the third through sixth embodiments, however, it may be divided into right and left sections or obliquely divided sections depending on the shape of a cast body to be produced. Furthermore, the lower mold member 4 and/or the upper mold member may comprise a plurality of sections as occasion demands.

In this case, the position and number of the sprue may be appropriately determined in accordance with the shape of the mold used and are not limited to the aforementioned embodiments. For example, the sprue is not necessarily provided on the upper mold member, and may be provided on the side mold member or at another position of the mold. Each of the casting apparatus according to the embodiments adopts forced cooling means employing a cooling plate, but the present invention can be applied to a casting apparatus not including forced cooling means. The present invention can be applied to any casting apparatus so long as the casting apparatus has a structure in which a sprue is opened or closed by means of an opening/closing plug. Each of the casting apparatus according to the seventh through thirteenth embodiments employs forced cooling means in which cooling water is sprayed from the spray nozzle to the cooling plate, but the casting apparatus may employ another forced cooling means. For example, when forced cooling means in which cooling water is permitted to pass through a passage formed in the cooling plate is applied to the casting apparatus, the direction of the solidification interface of molten metal can be arbitrarily regulated regardless of the shape of a cast body to be produced.

INDUSTRIAL APPLICABILITY

As described above, according to the present invention, a member having a sprue-defining wall is separable from a mold, and the member having the sprue-defining wall is removably provided on the mold. Therefore, the member having the sprue-defining wall can be handled as a single member, and the dimensional accuracy of a sprue can be enhanced without requiring very high working cost and a troublesome operation. Consequently, high dimensional accuracy, i.e. dimensional accuracy on the order of 1/100 mm, of the opening/closing plug and the sprue can be attained, and a technique for producing a cast body with high accuracy can be easily realized at low cost.

Since the member having the sprue-defining wall is separable from the mold, the casting apparatus of the present invention has advantages in terms of maintenance and control. For example, costs required for exchange of the member having the sprue-defining wall when the member is damaged can be reduced, costs for producing the mold can be reduced, and a small space for storing the mold will suffice.

What is claimed is:

1. An apparatus for casting an ingot, comprising a molten metal reservoir (51) positioned at an upper portion, a casting chamber (5) positioned at a lower portion and a partition wall (3) between the reservoir and the chamber, a sprue (7) formed in the partition wall, an opening/closing plug (8) for opening and closing the sprue and control means for controlling an opening and closing operation of the plug, wherein the casting chamber is defined by a mold (1) comprising a lower mold member (4), a side mold member (2) and the partition wall (3) that constitutes an upper mold member, and at least one of the lower mold member, side mold member and upper mold member comprises a plurality of divided sections in accordance with a shape of a cast ingot C.

2. An apparatus for casting an ingot according to claim 1, wherein the side mold member (2) comprises a plurality of upper and lower sections, right and left sections and/or obliquely divided sections (21, 22, 23, 24, 26, 27, 27A).

3. An apparatus for casting an ingot according to claim 2, wherein at least one of the plurality of sections of the side mold member includes an insert member (25, 33, 34).

4. An apparatus for casting an ingot according to claim 1, wherein the lower mold member (4) comprises a plurality of sections in accordance with the shape of the cast ingot.

5. An apparatus for casting an ingot according to claim 4 wherein at least one of the plurality of sections of the lower mold member (4) includes an insert member (11).

6. An apparatus for casting an ingot according to claim 1, wherein the upper mold member (3) comprises a plurality of sections.

7. An apparatus for casting an ingot according to claim 6 wherein at least one of the plurality of sections of the upper mold member (3) includes an insert member (30, 30A, 30B, 30C, 30D 30E, 33, 34).

8. An apparatus for casting an ingot according to any one of claims 3, 5 and 7, wherein the insert member (25, 11, 30, 30A, 30B, 30C, 30D 30E, 33, 34) has a sloped surface for facilitation withdrawal thereof.

9. An apparatus for casting an ingot according to any one of claims 1 to 8, wherein the upper, side and lower mold members (3, 2, 4) are mutually positioned by positioning means.

10. An apparatus for casting an ingot according to any one of claims 1 to 9, further comprising air removing means (22*b*, 21*c*, 23*b*, 24*b*, 26*b*, 27*c*, 2*b*) for discharging air which remains in the casting chamber (5) when molten metal (M) is teemed from the reservoir (51) into the casting chamber (5) via the sprue (7).

11. An apparatus for casting an ingot according to claim 10, wherein an inner side surface of the upper mold member (2) defining the casting chamber (5) is sloped upward toward the air removing means.

12. An apparatus for casting an ingot according to claim 10, wherein an inner side surface of the upper mold member (2) defining the casting chamber (5) is sloped upward toward the sprue.

13. An apparatus for casting an ingot, comprising a molten metal reservoir (51) positioned at an upper portion, a casting chamber (5) positioned at a lower portion and a partition wall (3) between the reservoir and the chamber, a mold (1) that includes the partition wall, a member (30, 30A, 30B, 30C, 30D, 30E, 30F) with a wall defining a sprue (7) that is detachably attached to the mold and an opening/closing plug (8) brought into contact with or detached from the sprue-defining wall for opening and closing the sprue, wherein molten metal (M) is teemed into the casting chamber when the plug is detached from the sprue-defining wall, and teeming of the molten metal into the casting chamber is stopped when the plug is brought into contact with the sprue-defining wall.

14. An apparatus for casting an ingot according to claim 13, wherein the mold (1) comprises a lower mold member (4), a side mold member (2) and the partition wall (3) that constitutes an upper mold member, and at least one of the lower mold member, side mold member and upper mold member comprises a plurality of divided sections in accordance with a shape of a cast ingot C.

15. An apparatus for casting an ingot according to claim 13, wherein the mold (1) is provided at one end portion with forced cooling means so that the molten metal (M) teemed into the casting chamber is solidified unidirectionally from the one end portion toward the other end portion of the mold.

16. An apparatus for casting an ingot according to any one of claims 13 to 15, wherein the member with the wall defining the sprue (7) is attached to a hole (3*d*) formed in the mold (1).

17. An apparatus for casting an ingot according to claim 16, wherein the member with the wall defining the sprue is fitted in the hole (3*d*) when it is attached to the hole.

18. An apparatus for casting an ingot according to claim 16, wherein the member with the wall defining the sprue (7) and the hole (3*d*) are provided with screw threads (30*e*, 30*c*), and the member is screwed into the hole.

19. An apparatus for casting an ingot according to any one of claims 13 to 18, wherein the member with the wall defining the sprue (7) is formed on a periphery of the mold (1).

20. An apparatus for casting an ingot according to any one of claims 13 to 18, wherein the member with the wall defining the sprue (7) is formed from a first material, the mold is formed from a second material, and the first material has a thermal expansion efficiency lower than that of the second material.

21. An apparatus for casting an ingot according to any one of claims 13 to 20, wherein the member with the wall material has a bending strength higher that a bending strength of the second material.

22. An apparatus for casting an ingot according to claim 21, wherein the bonding strength of the first material is higher than a bending strength of the plug (8).

* * * * *